US012798867B2

(12) United States Patent
Greiner-Perth

(10) Patent No.: US 12,798,867 B2
(45) Date of Patent: Nov. 17, 2026

(54) LIQUID DISPENSER AND LIQUID CARTRIDGES FOR SUCH A LIQUID DISPENSER

(71) Applicant: Aptar Radolfzell GmbH, Radolfzell (DE)

(72) Inventor: Jürgen Greiner-Perth, Gottmadingen (DE)

(73) Assignee: APTAR RADOLFZELL GMBH, Radolfzell (DE)

( * ) Notice: Subject to any disclaimer, the term of this patent is extended or adjusted under 35 U.S.C. 154(b) by 60 days.

(21) Appl. No.: 18/715,178

(22) PCT Filed: Dec. 1, 2022

(86) PCT No.: PCT/EP2022/084137
§ 371 (c)(1),
(2) Date: May 31, 2024

(87) PCT Pub. No.: WO2023/099699
PCT Pub. Date: Jun. 8, 2023

(65) Prior Publication Data

US 2025/0187816 A1 Jun. 12, 2025

(30) Foreign Application Priority Data

Dec. 3, 2021 (EP) ..... 21212220

(51) Int. Cl.
*B65D 83/384* (2025.01)
*B65D 83/42* (2006.01)
*B65D 83/48* (2006.01)

(52) U.S. Cl.
CPC ..... *B65D 83/384* (2013.01); *B65D 83/42* (2013.01); *B65D 83/48* (2013.01)

(58) Field of Classification Search
CPC .... B65D 83/384; B65D 83/42; B65D 83/164; B65D 83/425
See application file for complete search history.

(56) References Cited

U.S. PATENT DOCUMENTS 3,682,355 A 8/1972 Lo
6,474,510 B2 11/2002 Frutin
(Continued)

FOREIGN PATENT DOCUMENTS

BE 726647 6/1969
DE 69822182 T2 4/2005
(Continued)

OTHER PUBLICATIONS

International Search Report, with English translation, issued in corresponding International Application No. PCT/EP2022/084137, date of mailing Mar. 3, 2023 (9 pages).
(Continued)

*Primary Examiner* — Jason K Niesz
(74) *Attorney, Agent, or Firm* — FLYNN THIEL, P.C.

(57) ABSTRACT

A liquid cartridge has an outer body composed of at least two wall components and which surrounds a pressure chamber for receiving pressurized gas and pressurized liquid. The liquid cartridge has an outlet opening which penetrates one of the wall components. The liquid cartridge has an outlet valve component held movably or fastened on an inner side of the pressure chamber on at least one wall component, and which, in a closed state, prevents liquid from leaving the pressure chamber through the outlet opening. The outlet valve component can be transferred to an open state by application of force from the outside. For separation of gas and liquid in the pressure chamber, the pressure chamber
(Continued)

includes a displaceable or deformable partition wall, which divides the pressure chamber into a gas chamber and a liquid chamber.

23 Claims, 16 Drawing Sheets

(56) References Cited

U.S. PATENT DOCUMENTS

| | | | | |
|---|---|---|---|---|
| 11,426,743 | B2 | 8/2022 | Barthelmes et al. | |
| 2016/0167868 | A1* | 6/2016 | De Maillard | B65B 3/04 53/410 |
| 2016/0280449 | A1* | 9/2016 | Mekata | B65D 83/384 |
| 2022/0023895 | A1 | 1/2022 | Mangold et al. | |

FOREIGN PATENT DOCUMENTS

| | | | |
|---|---|---|---|
| DE | 102018109457 | A1 | 10/2018 |
| DE | 202019102195 | U1 | 11/2019 |
| DE | 102019135148 | A1 | 6/2020 |
| EP | 3060495 | A1 | 8/2016 |
| EP | 3331775 | B1 | 2/2020 |
| EP | 4190192 | A1 | 6/2023 |
| GB | 1106986 | | 3/1968 |
| JP | 2005209348 | A | 8/2005 |
| WO | 2014026251 | A1 | 2/2014 |
| WO | 2015061071 | A1 | 4/2015 |
| WO | 2017021039 | A1 | 2/2017 |
| WO | 2023099699 | A1 | 6/2023 |

OTHER PUBLICATIONS

Written Opinion of International Searching Authority, issued in corresponding International Application No. PCT/EP2022/084137, date of mailing Mar. 3, 2023 (10 pages).

European Office Action issued in corresponding European Patent Application No. 22 829 554.9 dated Jul. 28, 2026 (6 pages).

* cited by examiner

LIQUID DISPENSER AND LIQUID CARTRIDGES FOR SUCH A LIQUID DISPENSER

FIELD OF APPLICATION AND PRIOR ART

The invention relates to the field of liquid dispensers, in particular the field of liquid dispensers for discharging pharmaceutical liquids or for discharging liquids from the field of personal hygiene and perfume, and also the field of liquid dispensers for discharging nicotine-containing or cannabis-containing liquids.

The invention primarily relates to the field of pressurized liquid cartridges which form part of such liquid dispensers and in which the liquid is stored prior to discharge. In addition to the liquid cartridge, such a liquid dispenser comprises a discharge device into which the liquid flows from the liquid cartridge and from which the liquid is dispensed into an environment. A liquid cartridge of the type in question and according to the invention contains pressurized liquid, so that there is no need for a pump for pumping the liquid for the purpose of dispensing it into the discharge device.

Liquid cartridges of the type in question and according to the invention are in most cases designed to be exchanged by the user and for this purpose can in particular be replaced without using tools. The emptied liquid cartridges are disposed of by the user. A new liquid cartridge is then inserted into or coupled to the discharge device.

The reuse of the discharge device is an advantage from the environmental point of view. However, used liquid cartridges remain as waste.

OBJECTIVE AND SOLUTION

The objective of the invention is to provide a design of a liquid cartridge and also filling techniques which allow simple production and which permit disposal that causes the least possible damage to the environment.

To achieve this objective, a liquid cartridge for receiving pressurized liquid is proposed, which is designed according to the invention in the manner described below. Such a liquid cartridge according to the invention, preferably together with the discharge device coupled to it, forms a liquid dispenser according to the invention. In addition, according to the invention, methods are also proposed for filling such a liquid cartridge in a manner according to the invention.

The liquid cartridge according to the invention has an outer body which is composed of at least two wall components and which surrounds a pressure chamber. Preferably, there are exactly two wall components that form the outer body. The wall components are connected to each other firmly and in a gas-tight manner via coupling geometries or by means of an adhesive bond or a welded connection; the connecting of the wall components in the manner explained below can take place before the filling procedure or in the course of the filling procedure.

The outer body surrounds the pressure chamber, which is provided to receive pressurized gas and pressurized liquid in separate chambers. To be able to remove liquid from the pressure chamber, an outlet opening is provided which penetrates one of the wall components. The pressure in the pressure chamber pushes the liquid through the outlet opening when the latter is opened.

In order to keep the outlet opening closed before use of the liquid cartridge and preferably also to close the outlet opening again for safety reasons after the liquid cartridge has been emptied, the liquid cartridge according to the invention has an outlet valve with an outlet valve component which, on an inner side of the pressure chamber, is held movably on or in particular fastened to at least one wall component and which, in a closed state, prevents liquid from leaving the pressure chamber through the outlet opening. During production, the outlet valve component is usually fastened to one of the wall components through its open side, before this is connected to a second wall component.

The outlet valve component can be transferred to an open state by external application of force from the outside, in particular by insertion of the liquid cartridge into a discharge device designed for this purpose. This allows an opening stub in particular to enter the outlet opening and apply force to the outlet valve component so that it is moved to its opening position. Alternatively, an actuation section which extends outwards through the outlet opening and has an externally accessible actuation surface for deflecting and thus opening the outlet valve component can also be provided on the outlet valve component.

In addition to the design with such an outlet valve, it is in principle also possible to use a closure member that opens irreversibly, for example a fixed membrane which withstands a pressure of several bar and which, upon insertion of the liquid cartridge into the discharge device, is cut by a needle or a blade of the discharge device in order to open.

The pressure chamber of a liquid cartridge according to the invention comprises a displaceable or deformable partition wall, which divides the pressure chamber into a gas chamber and a liquid chamber. The partition wall can in particular be a wholly displaceable partition wall as part of a separating piston or can be a wholly or partially flexible wall that surrounds the liquid chamber partially and preferably substantially. In addition, such a flexible wall is also referred to as a bag.

The internal volume of the pressure chamber including the liquid chamber and the gas chamber is preferably less than 200 ml, in particular preferably less than 118 ml. In the state in which the filled liquid cartridge is delivered, the liquid chamber itself preferably has a volume of less than 118 ml.

A liquid cartridge according to the invention can consist of a very small number of parts. If it is a liquid cartridge with a bag, it preferably has a maximum of four parts, namely the two wall components, the outlet valve component and the bag. If the outlet valve component and the bag are in one piece, there may even just be three parts. In a liquid cartridge with a separating piston, there are preferably exactly four individual parts provided, namely the two wall components, the outlet valve component and a one-piece separating piston.

The displaceable or deformable partition wall has the effect that an identical or very similar pressure preferably prevails in the gas chamber and the liquid chamber. In a design with a separating piston, there is preferably a slightly higher pressure in the gas chamber than in the liquid chamber. This will be explained below.

When the outlet valve component is brought into its open state, that is to say shifted or deformed accordingly, the pressure in the pressure accumulator ensures that liquid is dispensed through the outlet opening, while the liquid chamber correspondingly reduces in size and the gas chamber increases in size, with the gas pressure decreasing. The amount of gas in the gas chamber is such that all of the liquid or at least the vast majority of the liquid (>95%) is discharged at a sufficient pressure, preferably a pressure of at least 2 bar, particularly preferably at least 3 bar. When the liquid cartridge is first opened, the pressure in the pressure chamber is preferably more than 5 bar, preferably between 7 bar and 10 bar.

Preferably, two wall components form the outer body. On one of these wall components, preferably on a wall component forming a first end wall of the outer body, the outlet opening is provided, preferably arranged centrally on the end wall. The other wall component preferably forms a bottom wall opposite the end wall. For the purpose of introducing gas into the pressure chamber, an opening can also be provided here. A lateral surface of the outer body between the end wall and the bottom wall is preferably formed by the first of the two wall components. In a design with a separating piston, this lateral surface forms with its inner side a substantially cylindrical sliding surface, along which the separating piston slides. Preferably at the lower end of the lateral surface, the second wall component is circumferentially connected to the first wall component in a gas-tight manner.

The small number of parts of a liquid cartridge according to the invention allows cost-effective production. The small number of parts is also the reason why the liquid cartridge can be easily recycled, as will be explained below.

The outlet valve component, which alone or together with one of the wall components controls the outflow from the liquid chamber, can be formed in different ways.

In one possible design, the outlet valve component is a freely movable body which is not firmly held in a defined position by the wall components, but is instead freely movable in a valve chamber formed by one of the wall components. It is preferably a spherical body, in particular made of a thermoplastic elastomer (TPE), which, in an end position caused by overpressure in the liquid chamber, closes a valve opening.

However, an outlet valve component is preferred which is firmly connected to the wall components in places and in particular in the region of its edge, for example by means of a snap-fit connection or by being clamped between at least two wall components. The outlet valve component is inherently deformable so that, despite being fastened in the intended manner, it remains partially movable, so as to be able to shift between an open state and a closed state.

Outlet valve components are possible in which the outlet valve component itself has a valve opening that can be opened and closed, and also ones which together with a wall component form a valve opening.

In the first-mentioned embodiment, the outlet valve component is penetrated by the valve opening, wherein edges adjacent to the valve opening bear on each other in a closed state of the outlet valve component and are at least partially spaced apart from each other in the open state. The valve opening can be formed in particular by a valve slit, which closes by virtue of the shaping of the outlet valve component, if it is not mechanically pressed into an open position. Preferably, such a valve slit is provided on a structure of the outlet valve component curving in a dome shape towards the liquid reservoir.

The outlet valve component with integrated valve opening has pressure surfaces which face preferably in the direction of the liquid chamber and which are pressed against each other by the pressure of the liquid and thereby compress the edges adjacent to the valve opening. The pressure in the pressure chamber thus acts in the direction of a closed state of the outlet valve component. In one possible design of the latter, a thin-walled hose section is provided which is compressed from outside by the liquid in the liquid chamber so that, in the resulting flat configuration, it no longer allows liquid to pass through until it is widened by an external opening member.

The outlet valve component is opened for its intended purpose by an external opening member, in particular a filling stub during the filling procedure or by an opening stub of the discharge device during use. For this manner of opening to work without problems, it can be advantageous to provide an expansion structure at a side of the outlet valve component facing away from the liquid chamber, by means of which expansion structure an entering filling stub can expand the valve opening. This can involve inclined surfaces, in particular mutually opposing inclined surfaces on both sides of a valve slit.

In the case of outlet valve components that form a valve opening in conjunction with a wall component, provision is made that the outlet valve component closes by bearing on a valve mating surface of one of the wall components, preferably by bearing on the wall component penetrated by the outlet opening. In particular, the outlet valve component can be arranged in front of the outlet opening and, in order to close the valve, can bear circumferentially on an edge surrounding the outlet opening to the inside.

In a particularly preferred design of such an outlet valve component, the outlet valve component is designed as a valve plate that is preferably flat in the unloaded state. This is understood to mean an outlet valve component which has a substantially uniform thickness and which in particular can be produced preferably as a stamped part made of polyethylene (PE) or thermoplastic elastomer (TPE), although other production methods and/or materials are also conceivable.

Such a valve plate can be deflected by an opening pin or opening stub insertable from the outside, such that the valve plate assumes its open state by being at least partially spaced apart from the wall component on which it was previously bearing circumferentially. The valve plate is preferably fastened circumferentially, in particular all the way round, to the inner side of the outer body, preferably by means of a snap-fit connection.

To allow liquid to flow past the valve plate to the outlet opening, the valve plate preferably has at least one through-opening. At the same time, in such a design, the valve plate is preferably provided with an outer edge, which bears circumferentially against the inner side of the outer body and/or is held here. As an alternative to the through-opening, provision can also be made that the valve plate has an outer edge in which at least one indentation is provided on the outside, in the region of which indentation the edge is spaced apart from the inner side of the outer body. In such a design, the liquid can pass through the indentation to the outlet opening.

In the closed state of the outlet valve body, it preferably bears circumferentially around the outlet opening on the inner side of the outer body. In particular, a circumferential contact web facing in the direction of the valve plate can be provided on the inside of the outer body. This contact web serves as a valve mating surface, against which the valve plate bears in a particularly defined manner in the closed state. On account of the small surface area of the contact web, a comparatively high surface pressure and leaktightness are achieved.

In another possible design of the outlet valve component, the latter has a fastening region, by means of which it is secured to one of the wall components. In particular, the outlet valve component can for this purpose be latched onto a wall component and in particular onto a cylindrical wall section. The outlet valve component has a circumferential sealing edge which faces upwards in the direction of the outlet opening and which, in the closed state of the valve, bears on an inner side of the wall component or on a sealing component inserted into the wall component. The valve can be opened by a deformation and partial displacement of the outlet valve component, since this causes the outlet valve component and in particular its sealing edges to be lifted from the mating surface on the wall component or on the sealing component, such that a through-flow gap opens. In particular, the sealing edge can be deflected by means of an opening pin or opening stub insertable from the outside, such that the outlet valve component is thus elastically deformed and liquid can flow past the sealing edge to the outlet opening. The opening pin or opening stub can be an external part that does not belong to the liquid cartridge itself but is instead provided on the dispenser with which the cartridge is used. However, it can also be a part of the liquid cartridge itself, in particular a component separate from the outlet valve component, since the separate design makes it possible to easily provide an opening between an internal channel in the opening stub and the outlet valve component, through which opening the liquid flows into the opening stub.

In particular, it can be provided that the outlet valve component has a cup-like depression for receiving the opening pin or opening stub. A circumferential and upwardly facing end edge of the cup-like depression, as it were the rim of the cup shape, can preferably form said sealing edge.

The described outlet valve component is fastened at the edge and can be deflected in the cup region. It is considered preferable if, for the purpose of such deformation, the outlet valve component has a circumferential deformation region in which the average wall thickness is reduced compared to a wall thickness in the fastening region and in the central region and/or a reduced stiffness is achieved by other measures such as the material selection. In particular, the outlet valve component preferably has such a deformation region between the attachment region and the sealing edge, which deformation region has a reduced stiffness and/or reduced wall thickness compared to the attachment region and the sealing edge.

It has proven particularly advantageous if the deformation region is not flat but has a shape deviating from this, in particular a tapering shape, for example a conical shape. Furthermore, at least one through-opening is preferably provided in the deformation region, through which the liquid can flow in the direction of the outlet opening. Such a through-opening or preferably a plurality of such through-openings promote the deformability of the deformation region. The configuration as regards the through-openings and the wall thickness can influence the closing force and thus the required opening force of the valve.

As was already explained at the outset, the partition wall between the liquid chamber and the gas chamber is preferably formed by a separating piston or a bag.

If the partition wall is formed by a separating piston, the latter is provided to be movable by sliding along an inner side of the outer body. The gas chamber is provided on the side of the separating piston facing away from the outlet opening, and the liquid chamber is provided on the side of the separating piston facing the outlet opening.

The separating piston has, surrounding the partition wall, a structure suitable for sliding on an inner side of the outer body. Preferably, this structure comprises a substantially cylindrical lateral surface, which serves as a sliding surface. This can result in a cup-like structure of the separating piston. This structure, or another structure asymmetric with respect to the longitudinal axis, can have the effect that an overflow into the gas chamber when there is an overpressure in the liquid chamber is greater than an overflow into the liquid chamber when there is an overpressure in the gas chamber. This can be utilized in the manner described below when filling the pressure accumulator, in order to enable filling of the gas chamber through the liquid chamber.

In order to facilitate filling of the gas chamber through the liquid chamber, a bypass channel can be provided on the inner side of the outer body and, when the separating piston is arranged in the region of the bypass channel, allows liquid to flow around the separating piston. Such a bypass channel is provided as a localized depression in the sliding surface. If the separating piston is arranged in the region of this depression, incoming gas can flow into the depression in the region of the separating piston and can thus enter the gas chamber beyond the separating piston. If the separating piston is later moved out of the initial position, then, in the case of a design with a bypass channel, it provides substantial circumferential sealing, such that there is no longer any relevant bypass flow.

It is preferred that the mobility of the separating piston in the pressure accumulator is mechanically limited, so that in this way the gas chamber cannot be arbitrarily reduced in size. Preferably, the limitation is such that the gas chamber occupies at least 20% of the internal volume of the pressure chamber, preferably at least 30%. Such a limitation prevents a situation where the gas chamber is reduced too much in size during the filling of the pressure accumulator and then can no longer be enlarged. A structural possibility for such limitation is one in which stop elevations are provided on the inner sliding surface of the outer wall and cannot be passed by the separating piston. However, since this makes production difficult, it is preferably provided that the separating piston and/or a bottom wall of the outer body is provided with a spacer, by means of which a minimum distance between the bottom wall and the separating piston is ensured.

If the partition wall is formed by a bag, it is the flexible bag wall of the bag that allows the reduction in size of the liquid reservoir. The liquid chamber is provided to the inside of the bag wall, while the gas chamber is provided between the bag wall and the outer body.

The bag can be made from a flexible material or can have a limited elastic restoring tendency. Particularly preferably, the bag can be designed as a tube, in other words, starting from an elongate hollow body, can be formed by pressing together and connecting the edges at the ends.

The design of the partition wall as a bag wall can preferably entail that the bag body and the outlet valve component are formed in one piece, such that the minimum number of components of the liquid cartridge can be reduced to three components.

As has already been explained, the special significance of a liquid cartridge according to the invention is that it can be designed to be easily recycled. By judicious choice of the materials, it is possible for the wall components, the partition wall and the outlet valve component to be recyclable in a common recycling process. This does not mean that the materials of all the components have to be identical, but that they can be separated from one another in a customary process. In particular, for good recycling, it is advantageous if the liquid cartridge consists predominantly of a polyethylene terephthalate (PET), in particular with the wall components made of PET. The proportion of PET in the total mass of the emptied liquid cartridge is preferably at least 60%, particularly preferably at least 75%.

The lighter materials PE and PP are easy to separate from PET, and these are therefore preferably used for the separating piston, the bag body and/or the outlet valve component. In particular, PE can be used for the separating piston, the bag and/or the outlet valve component. However, the outlet valve component and the bag can also be made of TPE.

The total proportion of said three materials PET, PE and PP in the total mass of the emptied liquid cartridge is preferably at least 75% of the mass of the liquid cartridge from these materials, particularly preferably at least 90%.

It is preferred if all the components of the liquid cartridge are produced from materials from the group comprising polyethylene terephthalates (PET), polyethylenes (PE), polypropylenes (PP) and thermoplastic elastomers (TPE). On account of the non-ideal recyclability of TPE, the proportion of TPE in the total mass of the emptied liquid cartridge is preferably less than 5%, particularly preferably less than 2%.

A liquid cartridge according to the invention can be used in various types of liquid dispensers.

Thus, the liquid cartridge can be filled in particular with a low-viscosity pharmaceutical liquid or with a liquid serving for personal hygiene, and it may be provided in particular that this liquid is discharged in the form of a spray jet.

Another field for which the liquid cartridge is suitable is the field of liquid dispensers for discharging a nicotine-containing and/or cannabis-containing liquid, in particular for stopping smoking. Such a liquid is also preferably dispensed in the form of a spray jet, in particular at a low liquid flow rate.

However, a liquid cartridge according to the invention is also well suited for highly viscous liquids such as skincare cream or toothpaste. By virtue of the achievable pressure of initially over 6 bar, it is possible for a discharge to be guaranteed even in cases where dried residues of the liquid are present in the region of the outlet opening. Compared to a pump system, a much greater pressure difference can be achieved between the liquid chamber and an environment at normal pressure.

Preferably, the liquid chamber is filled with one of the liquids mentioned. The gas chamber is filled with a compressed gas, preferably air.

As has already been explained at the outset, the at least two wall components are connected to each other firmly and in a gas-tight manner. Preferably, they are connected to each other via an adhesive bond or a welded connection, wherein the welded connection can preferably be a laser-welded connection, a friction-welded connection or an ultrasound-welded connection.

In addition, however, a connection technique is also possible in which two wall components are connected to each other by formation of a sealing interference fit. In such a case, a coupling device is preferably provided which comprises a threaded connection with an external thread and an internal thread on the two wall components. This allows the wall components to be pressed against each other with high force in order to achieve gas tightness. It is particularly advantageous if at least one of the wall components is provided with a conical expansion or constriction in order to achieve the interference fit by screwing in the course of the other wall component being pushed in or pushed on.

In order to be able to fasten the liquid cartridge to a discharge device and thus allow the outlet valve to open, suitable coupling means can be provided. In particular, an external thread or a bayonet for coupling to a discharge device can be provided on an outer side of the outer body and in particular on the lateral surface of the outer body. Corresponding coupling means will be provided on an inner side of a receiving chamber of the discharge device.

It is preferred that, during the filling of a liquid cartridge according to the invention, the gas enters the pressure chamber through the outlet opening. However, designs are also possible in which a separate gas filling opening is provided in at least one of the wall components and leads into the gas chamber to bypass the liquid chamber. Preferably, the wall component in question has a valve device which is closed by overpressure in the gas chamber. For example, this can be a sleeve which widens in the direction of the gas chamber and which is widened by the gas pressure in the gas chamber and thereby closes the gas filling opening. If there is an external overpressure, the sleeve is compressed and the valve thus opened. A plug component for closing the gas filling opening is also possible instead of or in addition to a valve.

It is preferred that at least one of the wall components, particularly preferably all of the wall components, consist(s) of a transparent plastic, in particular PET. This makes it possible to easily check the filling level of the liquid cartridge.

As was already explained at the outset, the invention also comprises a liquid dispenser for discharging liquid. This liquid dispenser comprises a discharge device and a liquid cartridge of the described type fastened to or in the discharge device. The coupling of the liquid cartridge to the discharge device is effected in a releasable manner, such that the liquid cartridge, when empty, can be replaced by a new one, preferably without use of tools.

The liquid cartridge can be pushed completely or largely into a receiving chamber of the discharge device so that it is no longer visible or barely visible from the outside. Preferably, an internal thread or a bayonet for coupling to the liquid cartridge is provided on an inner side of a lateral wall of the receiving chamber. It is preferred that the lateral wall is designed to be transparent, so that the presence of a liquid cartridge in the receiving chamber and, if necessary, the filling level of the liquid cartridge can be easily monitored.

As an alternative to such a receiving chamber, however, it may also be provided that the liquid cartridge is for the most part exposed to the outside and thus itself forms a part of the outer surface of the liquid dispenser.

Preferably, for opening the outlet valve, the discharge device has an opening pin or an opening stub, which protrudes through the outlet opening into the liquid cartridge and acts there on the outlet valve component. The opening pin or opening stub can be provided for opening the outlet valve permanently or as and when required.

In a preferred design with permanent opening of the outlet valve by the opening pin or opening stub, provision is made that the discharge device has, in addition to the outlet valve component, a drain valve which is manually switchable by means of an actuation surface and is arranged downstream of the outlet valve. In such a design, it is therefore provided that the outlet valve of the liquid cartridge is permanently opened by the discharge device, and the liquid pressure is then applied at the drain valve of the discharge device. This has to be suitably designed to close against the pressure of the pressure accumulator.

Alternatively, it can be provided that the discharge device has an actuation surface for manual actuation, wherein this actuation surface is coupled to an opening pin or opening stub which, when actuated, applies force to and thus opens the outlet valve component. Therefore, in such a design, a second valve is not required since, when the discharge device is actuated, the outlet valve of the liquid cartridge opens immediately and closes again at the end of the actuation of the actuation surface, in particular on account of the liquid pressure in the liquid chamber.

The aforementioned opening stub preferably has a sleeve-shaped or tubular form, wherein the outer side of the opening stub preferably has a diameter that bears sealingly in a radial direction against an inner side of the outlet opening.

As has already been mentioned, the liquid cartridge and the discharge device are suitable for various liquids and application forms, for example also for the discharge of highly viscous liquids. However, a design is preferred in which the liquid is discharged in the form of an atomized spray jet. In order to achieve this, the discharge device is preferably provided with a correspondingly designed outlet opening, for example with an upstream vortex chamber. A design is preferred in which the discharge device has a discharge nozzle device comprising a nozzle plate with at least one nozzle opening. Preferably, the discharge nozzle device has a plurality of discharge nozzle openings. At their narrowest point, the nozzle openings preferably have a clear cross section of between 10 $\mu m^2$ and 200 $\mu m^2$, particularly preferably of between 40 $\mu m^2$ and 100 $\mu m^2$. Preferably, at least 20 nozzle openings are provided. The discharge nozzle unit, in particular the nozzle plate, preferably has nozzle openings which generate fine individual jets which, after their emergence, decay into individual droplets, particularly in the form of a decay without influence of air (Rayleigh decay).

A liquid cartridge according to the invention is filled with gas and liquid before delivery to the end customer. In practice, at least the filling with liquid usually does not take place at the location where the components of the liquid cartridge are manufactured, but at a location set up for the filling operation. The gas filling can take place at the site of production of the liquid cartridge or at the specified filler.

Starting with the still empty dispenser, in which air under normal pressure is usually initially contained, the filling with gas, in particular with air, and also with liquid takes place, wherein different filling methods provide different sequences. Simultaneous filling with gas and liquid is also possible if the liquid cartridge has a gas filling opening besides the outlet opening.

There are several variants by means of which the gas is introduced into the gas chamber through an opening different from the outlet opening. In one of these variants, the gas is introduced into the gas chamber through an opening of a wall component before the opening is closed by connection of the wall component to a second of the wall components. This means that the at least two wall components are still separate from each other before the gas filling procedure.

Alternatively, the gas filling procedure can be carried out using the opening already described and provided for this purpose. Accordingly, the wall components can already be connected to each other before the gas filling procedure. To prevent the gas from escaping again through the gas filling opening after the filling procedure, an integrated gas filling valve then closes, or the gas filling opening is closed by means of a plug component.

In a fundamentally different form of a filling procedure, both the gas and the liquid are introduced in succession through the outlet opening into the pressure chamber. In this procedure, the liquid cartridge can already be fully assembled prior to filling.

One way to fill the gas chamber with gas and the liquid chamber with liquid through the same outlet opening entails that the gas is first introduced into the pressure chamber, wherein it enters the liquid chamber and then passes the separating piston into the gas chamber.

Preferably, a bypass channel of the type described above is provided for this purpose.

Alternatively, the separating piston is designed in such a way that, with an overpressure in the liquid chamber, it allows gas to flow past to a small extent. After the gas has been introduced, the liquid is then introduced into the liquid chamber from below, in a position of the liquid cartridge with the liquid chamber arranged at the bottom. The liquid and its pressure displace the gas from the liquid chamber into the gas chamber.

Although it may be provided according to the described method that the gas chamber is filled with gas past the separating piston, this does not mean that, after filling with gas and liquid, an exchange between the gas chamber and the liquid chamber takes place through a narrow surrounding gap at the separating piston. On the one hand, this is prevented by the surface tension of the liquid. On the other hand, by virtue of the cup-like shape described above, the separating piston can tend to expand as soon as the pressure in the gas chamber is higher than in the liquid chamber. Such a situation arises when liquid is removed from the liquid chamber, since the separating piston, when suitably designed, does not compensate for every minimal pressure difference between the gas chamber and the liquid chamber on account of its circumferential friction, and therefore the pressure in the gas chamber remains slightly higher compared to the liquid chamber.

Since, during filling with gas, there is a risk of the separating piston being pressed to its end position facing away from the outlet opening and of the gas chamber thus being reduced too much in size, the above-described stop surface or the above-described spacer can be used to limit the reduction in size of the gas chamber during the filling procedure.

If the separating piston is intended to remain in a defined position during the filling of the pressure chamber with gas, for example in a position in which it promotes the flow of gas into the gas chamber via the bypass channel, it is possible to provide holding means such as a constriction, detents or the like. To be able to move the separating piston out of the defined position after the gas filling procedure, a gas pressure surge or liquid pressure surge can be used. It is also possible that, in the course of the filling procedure, a tool is inserted through the outlet opening, which tool reaches into the region of the separating piston and applies force directly to the latter away from the outlet opening.

BRIEF DESCRIPTION OF THE DRAWINGS

Further advantages and aspects of the invention will emerge from the claims and from the following description of preferred exemplary embodiments of the invention, which are explained below on the basis of the figures.

DETAILED DESCRIPTION OF THE EXEMPLARY EMBODIMENTS

Figure 1:
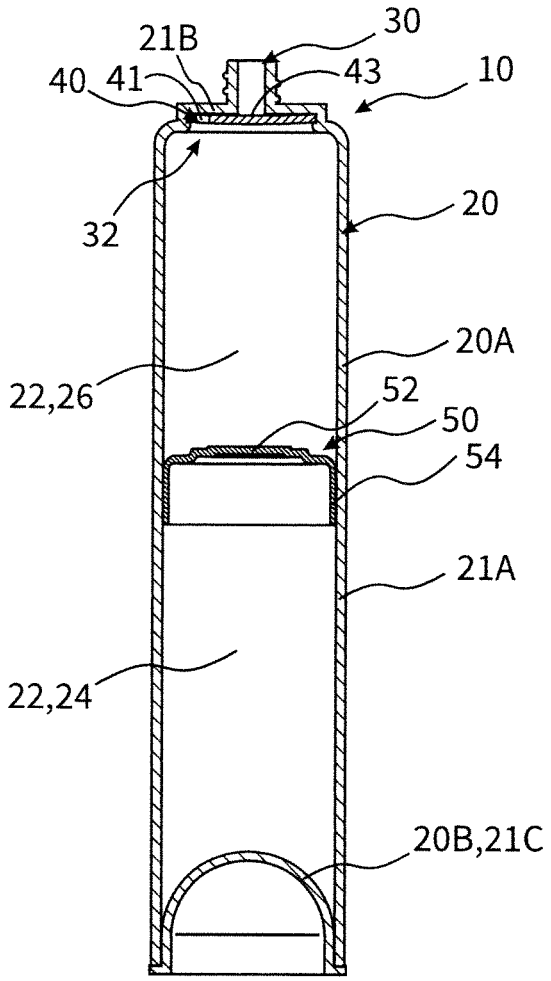
FIG. 1 shows a first exemplary embodiment of a liquid cartridge according to the invention.

FIG. 1 shows a first exemplary embodiment of a liquid cartridge 10 according to the invention.

The liquid cartridge 10 has an outer body 20 made of PET. This outer body 20 is composed of two wall components 20A, 20B. The wall component 20A forms a lateral wall 21A and an upper end wall 21B, in the region of which an outlet opening 30 is provided. The wall component 20B forms a bottom end wall 21C, which has a curved shape and, in the assembled state in FIG. 1, is connected in a gas-tight manner to the first wall component 20A, in particular by means of a welded connection or an adhesive bond. Together, the wall components 20A, 20B forming the outer body 20 surround a pressure chamber 22, which is divided into a gas chamber 24 and a liquid chamber 26 by means of a separating piston 50. In addition to the actual partition wall 52, the separating piston 50 has a jacket section 54, which is displaceable by sliding along an inner side of the lateral wall 21A.

The outlet opening 30 is preceded by an outlet valve 32 which, in the exemplary embodiment of FIG. 1, is formed by a substantially flat valve plate 40 as outlet valve component 40, which is connected circumferentially to the wall component 20A by a snap-fit connection. To allow liquid to flow past the valve plate 40, the latter is provided with a through-opening 41.

Figure 2:
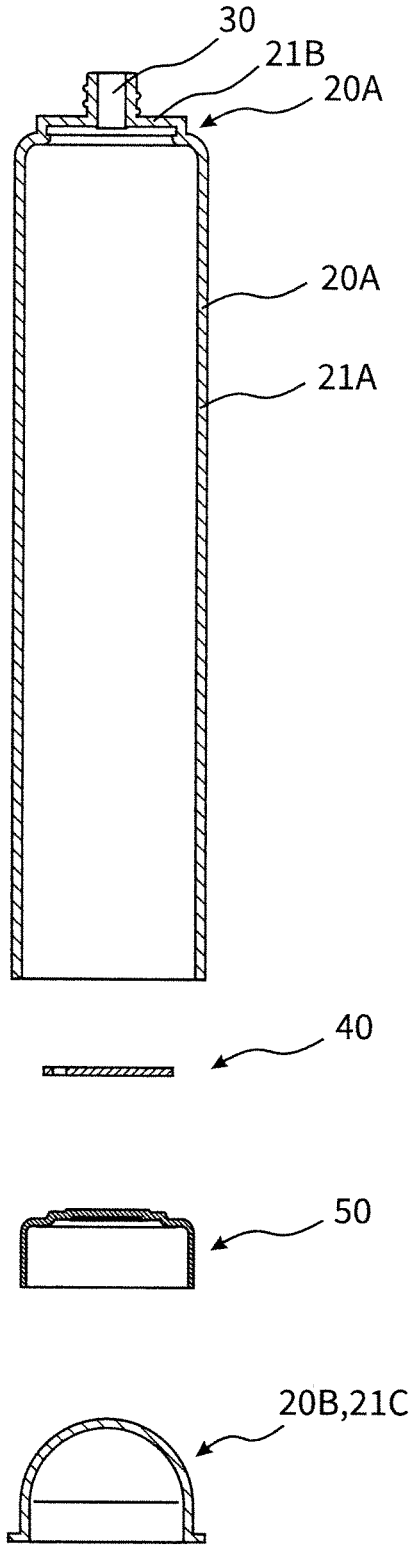
FIG. 2 shows the liquid cartridge of FIG. 1 in disassembled form.

FIG. 2 again shows all four of the individual components of the liquid cartridge 10. The two wall components 20A, 20B are preferably produced from transparent PET. The valve plate 40 is preferably made of thermoplastic elastomer (TPE). The separating piston 50 is preferably made of PP. During assembly, the components 20B, 40, 50 are inserted from below into the wall component 20A.

The stated choice of materials means that, after the previously emptied liquid cartridge 10 has been disposed of, it can be very easily recycled. For this purpose, the liquid cartridge 10 is shredded as a whole in the usual manner, so that its individual parts completely separate from each other. The TPE of the outlet valve component represents a negligible contamination during recycling, but it only accounts for about 0.5% of the mass of the four components of FIG. 2. The parts released from one another by the shredding can be easily separated by means of float-sink separation, on account of the specific density of PP, which is lower than that of water, and of PET, which is higher than that of water.

Figure 3:
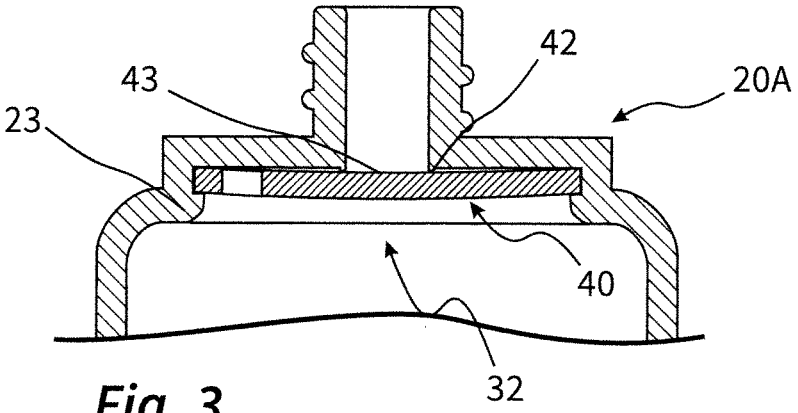
FIG. 3 shows an enlarged view of the outlet valve of the liquid cartridge of FIG. 1.

FIGS. 3 to 6 illustrate the design of the outlet valve 32 and alternatives to this. In FIG. 3, the outlet valve 32 is shown enlarged. It can be seen that the outlet valve component 40 formed as a valve plate 40 is held at the edge 48 by snap-fit projections 23. In the closed state in FIG. 3, the outlet valve 32 is closed. This is achieved by the fact that the valve plate 40 is slightly pretensioned with its upper face on a circumferential contact web 42 in the region of the entrance to the outlet opening 30. Since the liquid pressure pushes the valve plate more upwards than downwards, due to the surface ratios, it acts in the closure direction of the outlet valve 32. The outlet valve 32 is opened by means of the fact that, through the outlet opening 30, an opening pin or opening stub is inserted which presses on the valve plate in the region of an actuation surface 43, thereby increasing the curvature of the valve plate 40 and opening the gap between the contact web 42 and the valve plate 40. In this state, the outlet valve 32 is open and the pressurized liquid can escape.

Figure 4:
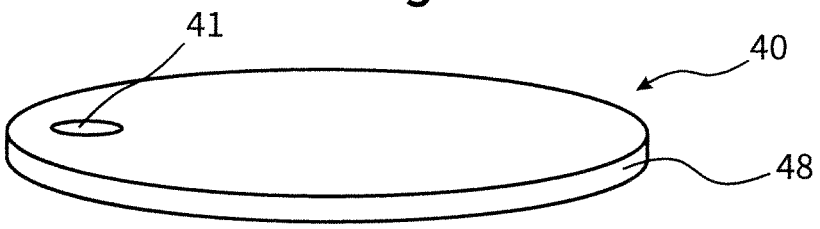
FIGS. 4 to 6 show different outlet valve bodies, which can be used in the liquid cartridge of FIG. 1.

The valve plate 40 of FIG. 3 is also shown separately in FIG. 4.

Figure 5:
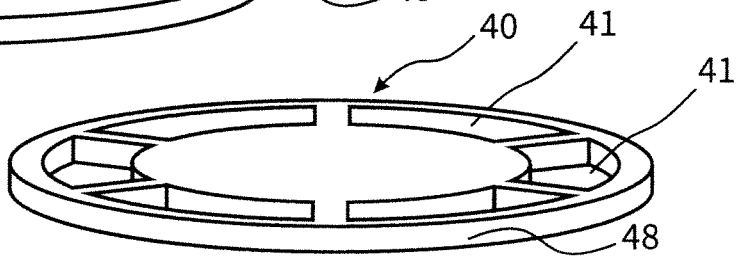
Figure 6:
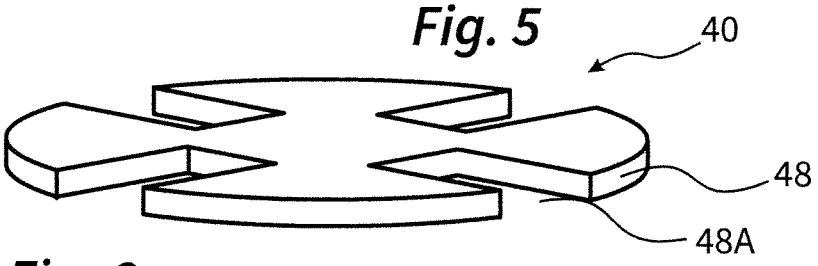

FIG. 5 shows an alternative design in which a plurality of through-openings 41 are provided. FIG. 6 shows a design in which a through-opening 41 is not provided, but instead edge-side indentations 48A, which also allow liquid to flow through the valve plate 40 and thus bear at the valve sealing point of the contact web 42 until the outlet valve 32 is opened.

The valve plates of FIGS. 4 to 6 can preferably be produced as stamped parts from TPE or PP. Production as a stamped part ensures particularly cost-effective manufacture.

Figure 7:
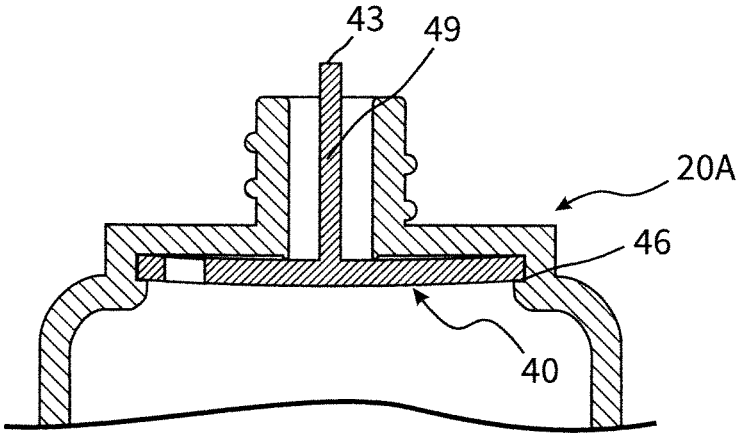
FIG. 7 shows an alternative design of an outlet valve.

FIG. 7 shows an alternative in which the outlet valve component is not formed as a flat valve plate, but is provided with an actuation pin 49, which protrudes outwards through the outlet opening 30. When this actuation pin 49 is pressed in by insertion of the liquid cartridge 10 into a discharge device, it presses on the actuation surface 43 at the outer end of the actuation pin 49 and thereby opens the outlet valve 32.

Figure 8:
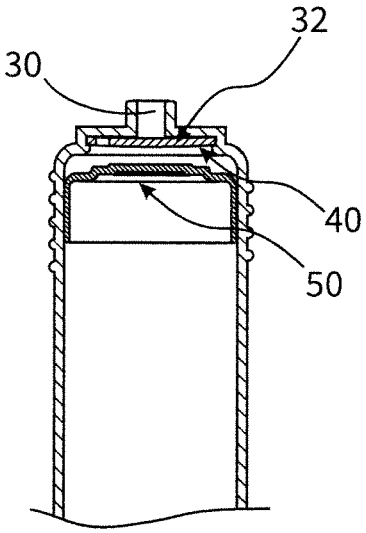
FIG. 8 shows once again the outlet valve of the liquid cartridge of FIG. 1.
Figure 9:
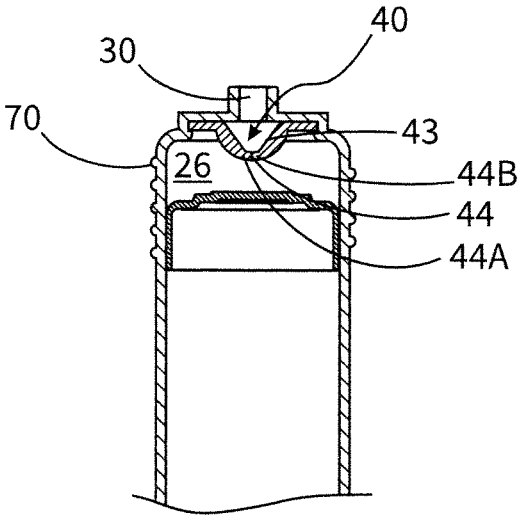
FIGS. 9 to 11 show further alternative designs.
Figure 10:
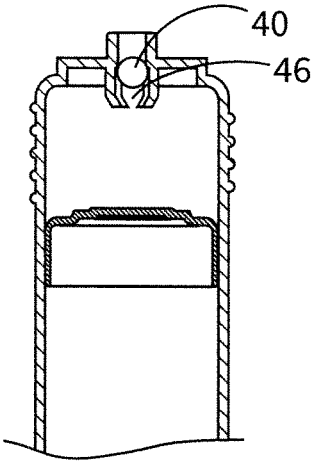
Figure 11:
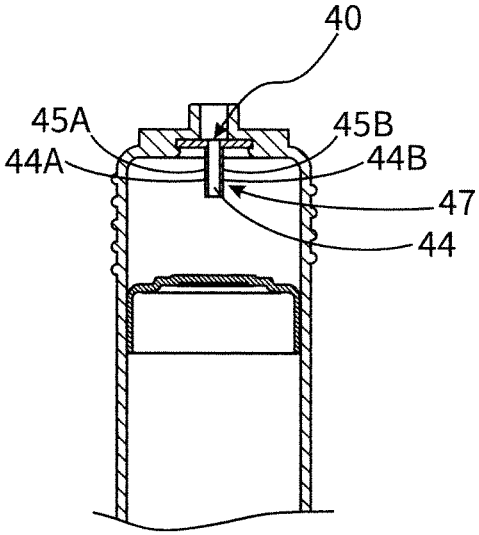

FIGS. 9 to 11 show further designs of the outlet valve component 40. In FIG. 8, the design from FIG. 1 is illustrated again.

The outlet valve component 40 of FIG. 9 is produced from an elastic plastic and has a dome-like elevation pointing in the direction of the liquid chamber 26. A valve opening 44 in the form of a valve slit 44 is provided at the apex of the dome, which slit is bounded by two edges 44A, 44B, which bear on each other for closing the valve. On account of the dome-like structure, the liquid pressure in the liquid chamber 26 acts on pressure application surfaces 45A, 45B in such a way that the valve is pressed into its closed position by the pressure. On the side facing away from the liquid chamber 26, inclined surfaces are provided as actuation surfaces 43 in order to facilitate opening of the outlet valve 32. This will be explained below.

FIG. 10 shows a design in which the outlet valve component 40 is not attached to the wall component 20A, but is freely movable in a valve chamber 46 to a limited extent. The liquid pressure in the liquid chamber 26 presses the outlet valve component 40 in the form of a TPE ball into the position in FIG. 10, in which it closes the outlet opening 30. If the ball is pushed downwards from outside by an opening pin, the valve opens.

In the design according to FIG. 11, the outlet valve component 40 has a hose section 47, which is produced from a thin-walled material. This has the effect that the liquid pressure in the liquid chamber 26 compresses this hose horizontally, thereby closing the outlet valve 32. In order to open the outlet valve 32, an opening pin or opening stub has to be inserted into the hose section 47 through the outlet opening 30.

Figure 12:
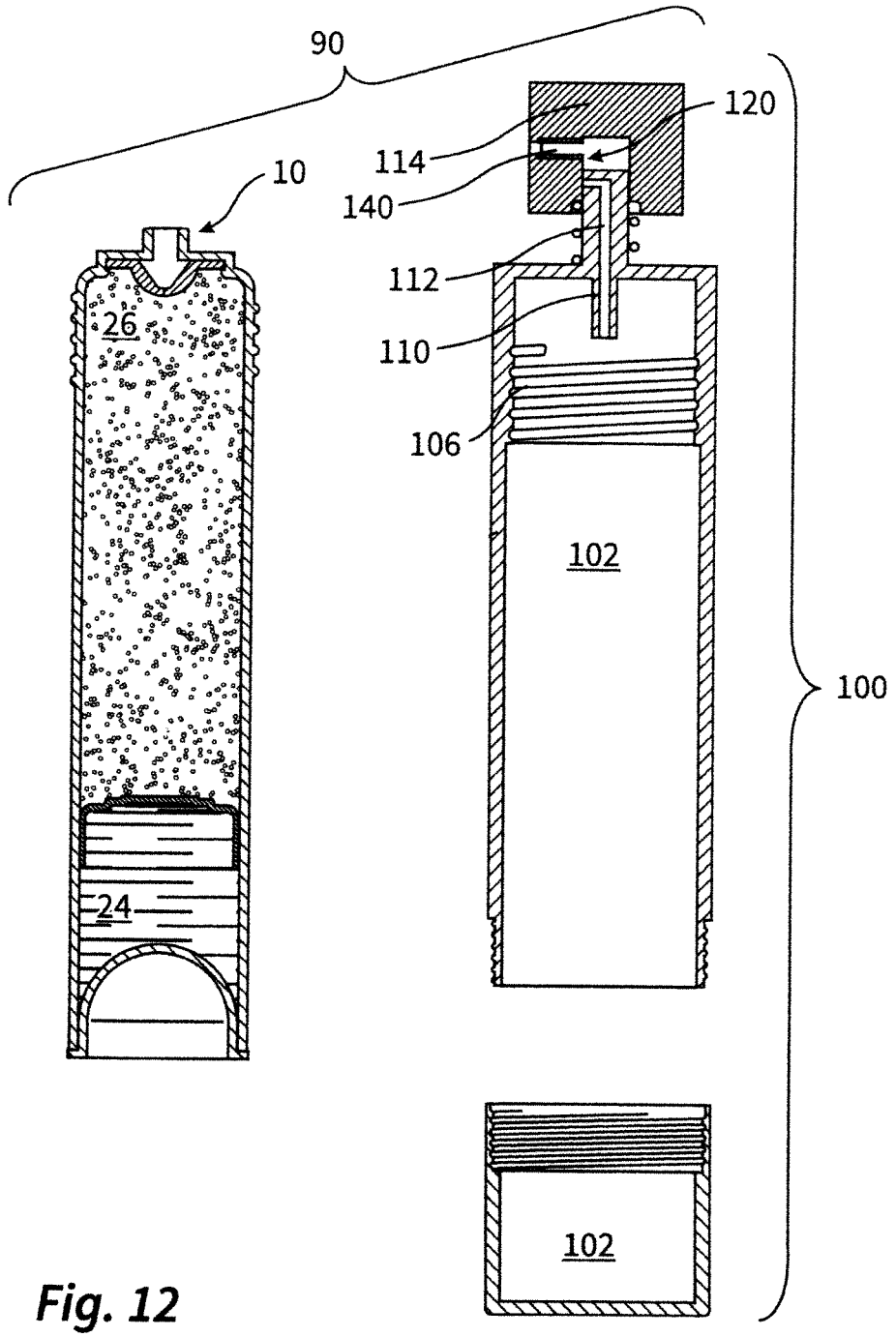
FIG. 12 shows, in addition to the liquid cartridge of FIG. 9, a discharge device with which the liquid cartridge is combined to form a liquid dispenser.

FIG. 12 shows the described liquid cartridge 10 with the valve according to FIG. 9, together with a discharge device 100 along with which the liquid cartridge 10 forms a functional liquid dispenser 90. The discharge device 100 has a receiving chamber 102 and an opening stub 110, which protrudes into this receiving chamber 102. The opening stub 110 surrounds an outlet channel 112 that leads to a depressible actuating push-button 114. The actuating push-button 114 is provided with a discharge valve 120, which is opened when the actuating push-button 114 is pressed down, so that the liquid can then flow out through a discharge nozzle device 140.

Figure 13A:
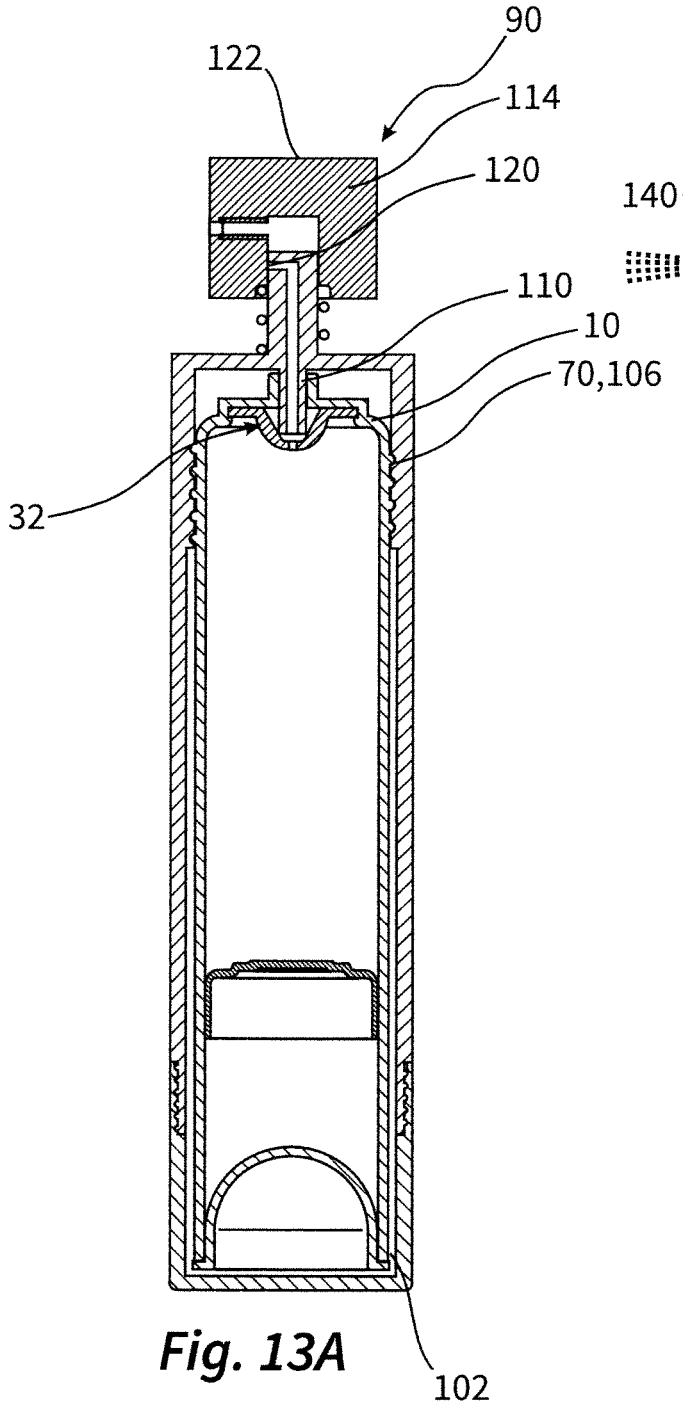
FIGS. 13A and 13B show the assembled liquid dispenser in the unactuated state and in the actuated state.
Figure 13B:
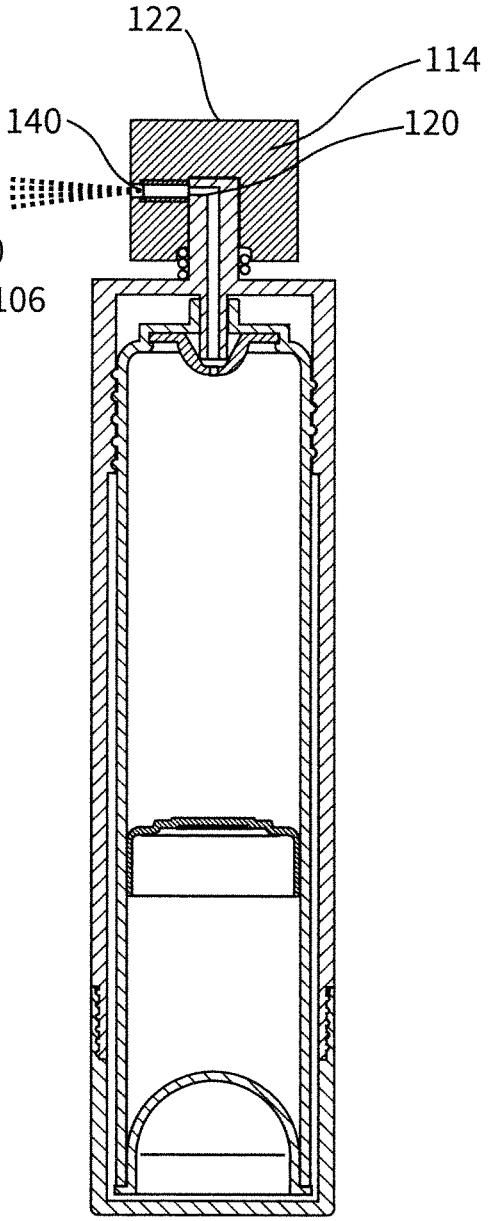

FIG. 13A shows the situation that arises when the liquid cartridge 10 is inserted into the receiving chamber 102 of the discharge device 100. It can be seen that the liquid cartridge 10 is screwed by means of an external thread 70 on the outer body 20 into a corresponding internal thread 106 of the discharge device 100, such that the opening stub 110 has opened the outlet valve 32. In this state in FIG. 13A, the liquid pressure of the liquid chamber 26 is present at the discharge valve 120. If the actuating push-button 114 is pressed down by way of its actuation surface 122, the liquid under pressure reaches the discharge nozzle device 140, where it is forced through fine nozzle openings and thus forms fine liquid jets, which decay beyond the discharge nozzle device 140 into individual droplets. This is shown in FIG. 13B.

Figure 14:
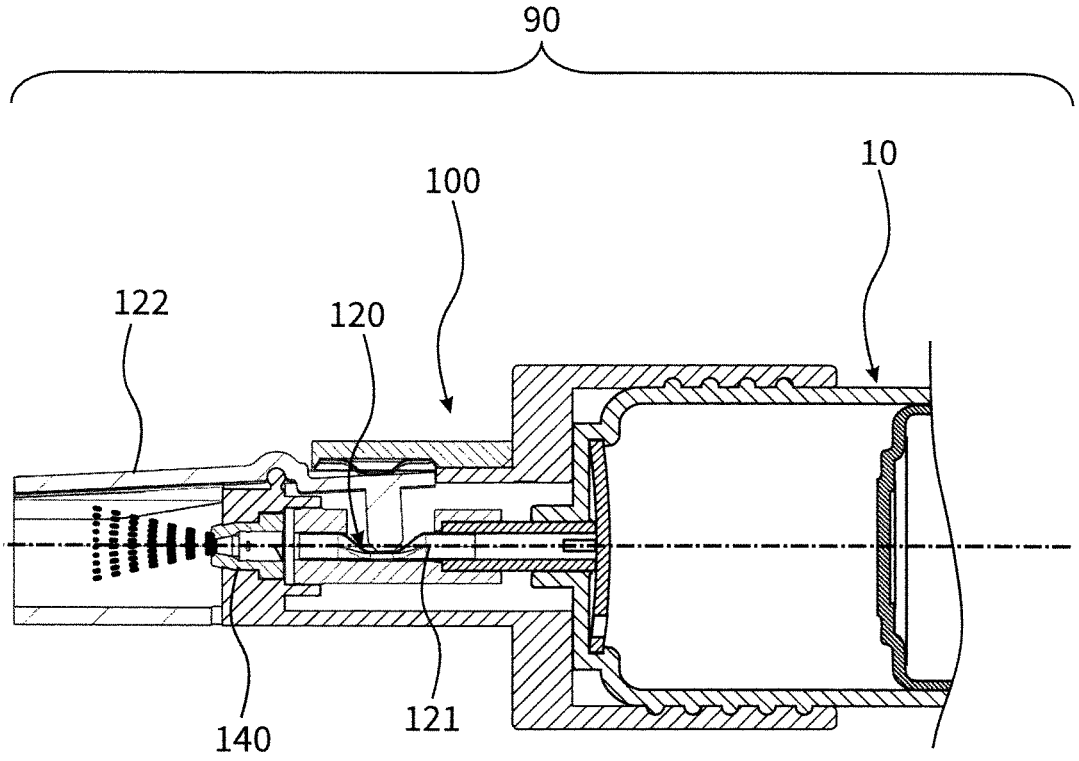
FIG. 14 shows another discharge device to which the liquid cartridge of FIG. 1 is connected to form a liquid dispenser.

FIG. 14 shows a second discharge device 100 for coupling a liquid cartridge 10. In this design, it is a liquid dispenser 90 for dispensing a nicotine-containing or cannabis-containing liquid. The discharge device 100 has a lip-operated discharge valve 120. When the user presses with their lip or teeth on the actuation surface 122, flow through the hose section 121 is enabled, and the liquid flows in atomized form out through the discharge nozzle device 140.

Figure 15:
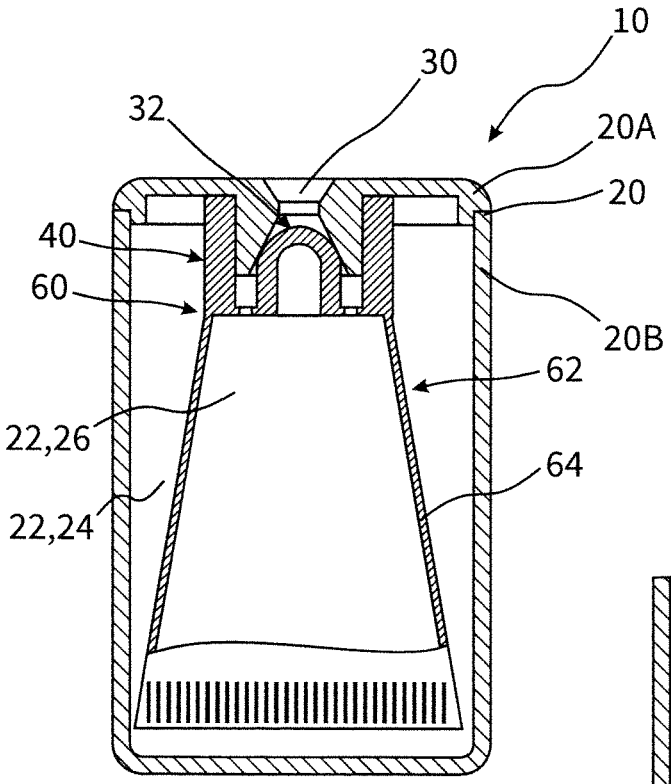
FIG. 15 shows a second exemplary embodiment of a liquid cartridge according to the invention.
Figure 16:
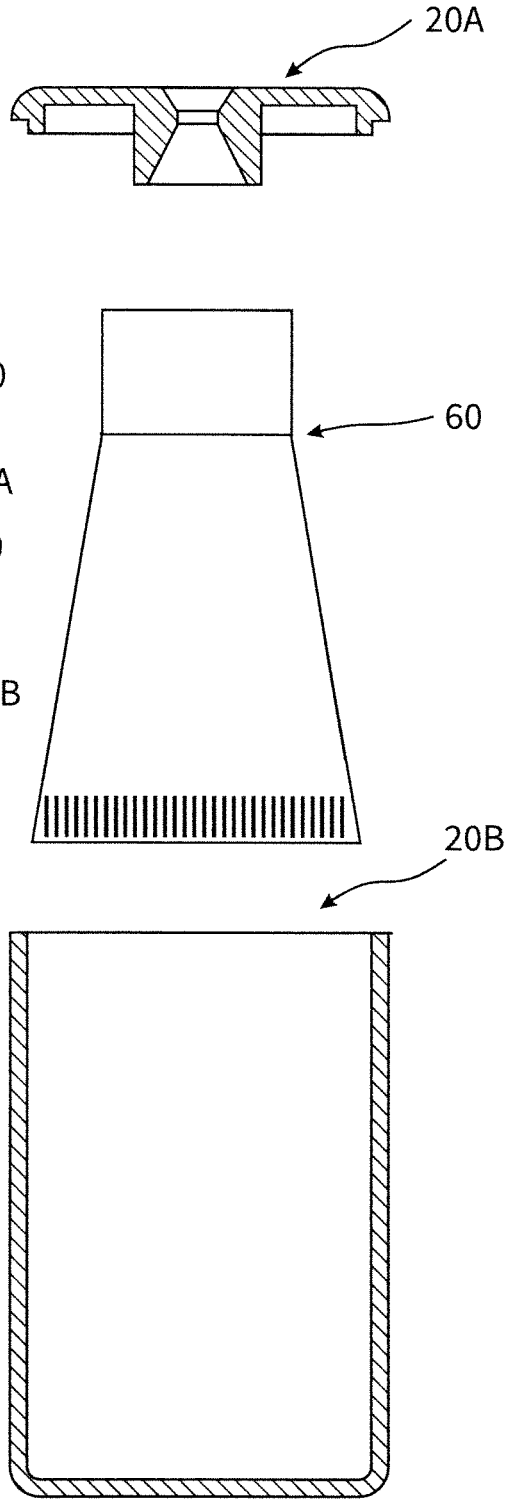
FIG. 16 shows the liquid cartridge of FIG. 15 in disassembled form.

FIGS. 15 and 16 show a fundamentally different design of a liquid cartridge 10. As can be seen from FIG. 16, it consists of only three parts, namely two wall components 20A, 20B and a bag 60, the latter having a bag body 62 with a bag wall 64, in the form of a tube, and an outlet valve component 40 connected to the latter in one piece. The outlet valve component 40 has a central pin which bears on a conical inner surface of the wall component 20A and thus keeps the outlet valve 32 in a closed state.

As can be seen from FIG. 15, the liquid chamber 26 in such a design is formed by the interior of the tube 60, while the space between the bag 60 and the inner side of the outer body 20, composed of the wall components 20A, 20B, forms the gas chamber 24.

In the design according to FIGS. 15 and 16, the gas chamber 24 is filled with gas at high pressure before the wall components 20A, 20B are connected to each other, in particular welded or glued to each other.

Figure 17:
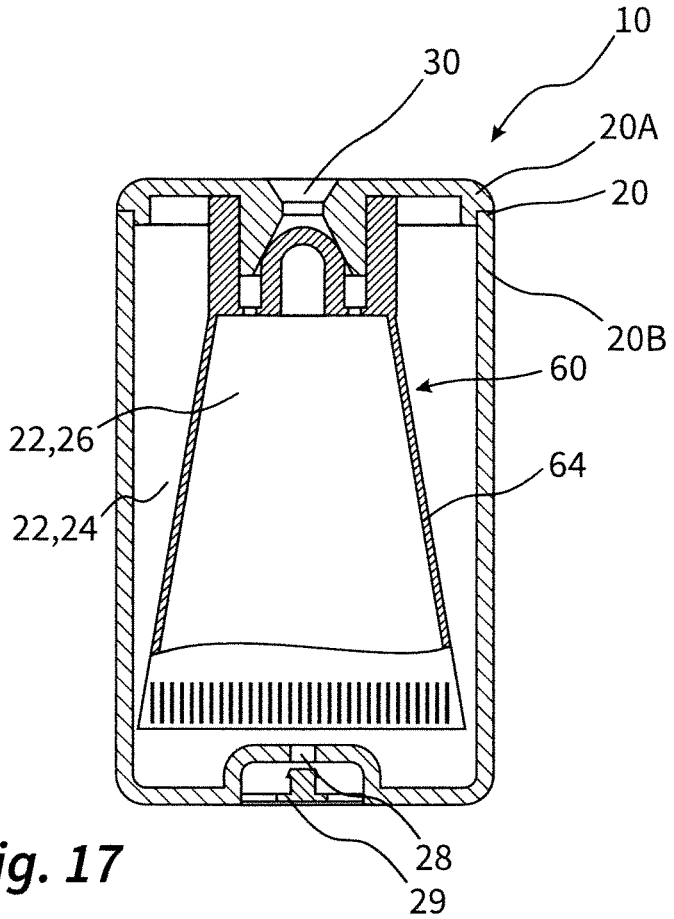
FIG. 17 shows a variant of the liquid cartridge of FIG. 15 with a separate gas filling opening.

In the design according to FIG. 17, it is alternatively provided that the wall component 20B has a gas filling opening 28, which is to be closed by means of a plug component 29 after the gas filling procedure.

Figure 18:
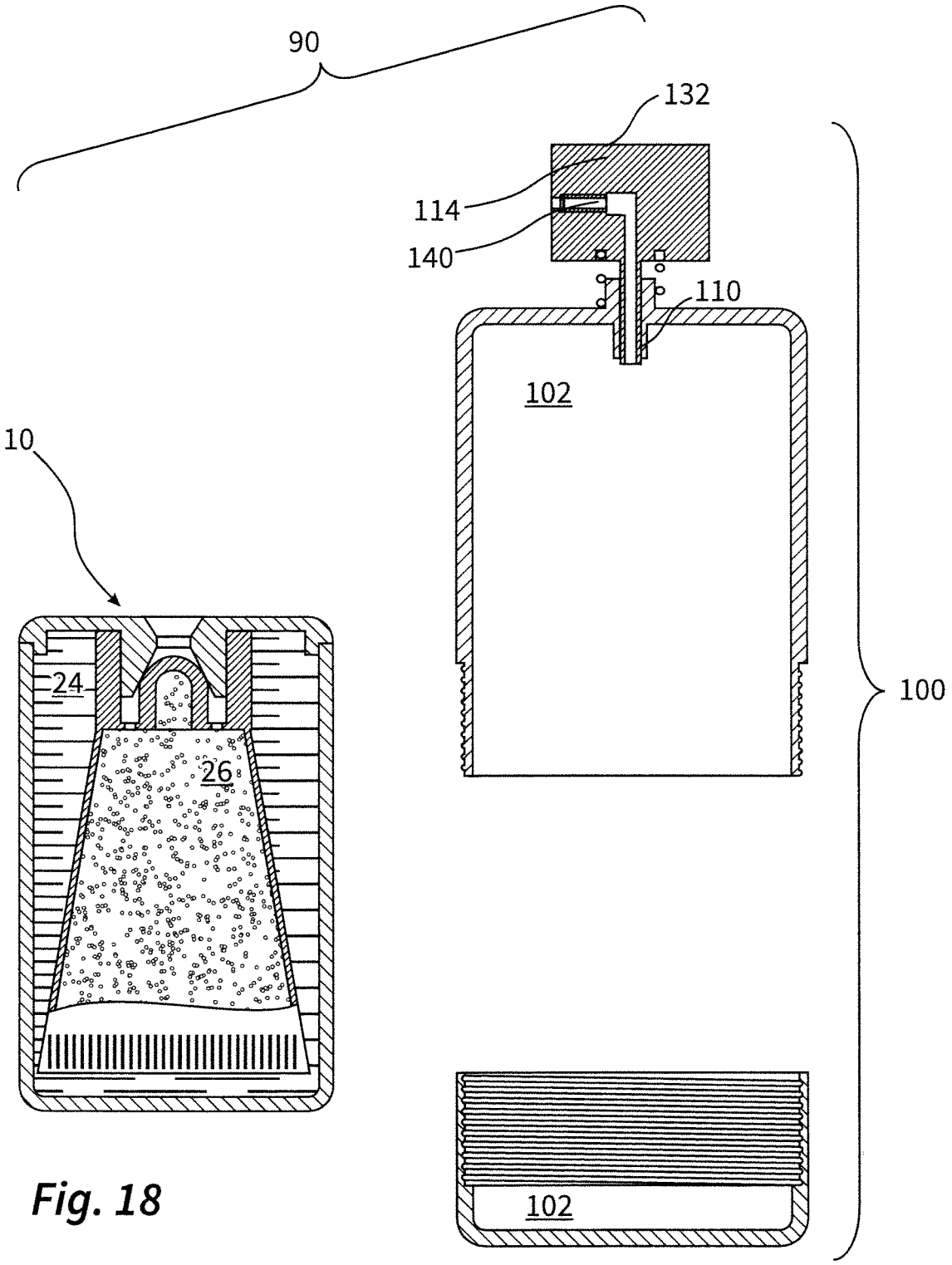
FIG. 18 shows, in addition to the liquid cartridge of FIG. 15, a discharge device with which the liquid cartridge is combined to form a liquid dispenser.

FIG. 18 shows again the liquid cartridge 10 from FIGS. 15 and 16 and a discharge device 100 adapted thereto.

Figures 19A, 19B:
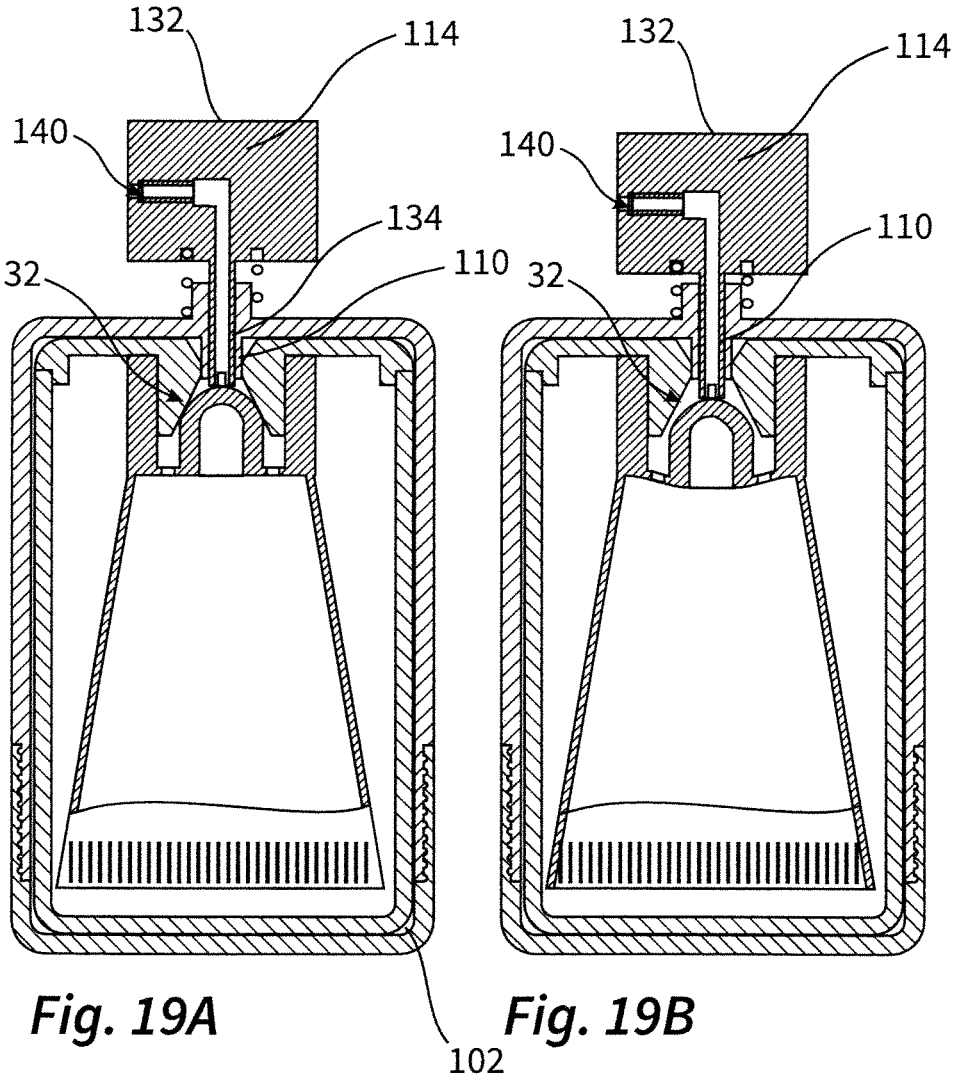
FIGS. 19A and 19B show the assembled liquid dispenser in the unactuated state and in the actuated state.

As can be seen from FIGS. 19A and 19B, the liquid cartridge 10 is inserted into a receiving chamber 102 of the discharge device 100, wherein, in the course of screwing the discharge device 100, a guide stub of the discharge device 100 penetrates into the outlet opening 30, but it does not yet cause deformation or opening of the outlet valve component 40. Starting from the state thus far reached in FIG. 19A, it is only when the actuating push-button 114 is pressed down via its actuation surface 132 that an opening stub 134 connected thereto and guided through the guide stub is pushed deeper into the outlet opening 30, such that it comes into contact with the outlet valve 32 and opens the latter. This initiates the discharge of the liquid. As soon as the actuating push-button 114 returns to its initial position, the outlet valve 32 can close again, such that the liquid discharge terminates.

Thus, in the design of FIGS. 19A, 19B, in a departure from the design of FIGS. 13A, 13B, the outlet valve 32 of the liquid cartridge 10 is the only valve, and the latter is opened from time to time when the user wishes to discharge liquid by pressing down the actuation surface 132.

FIGS. 20A to 23D show different ways in which the liquid cartridges described above are filled.

Figures 20A, 20B, 20C, 20D:
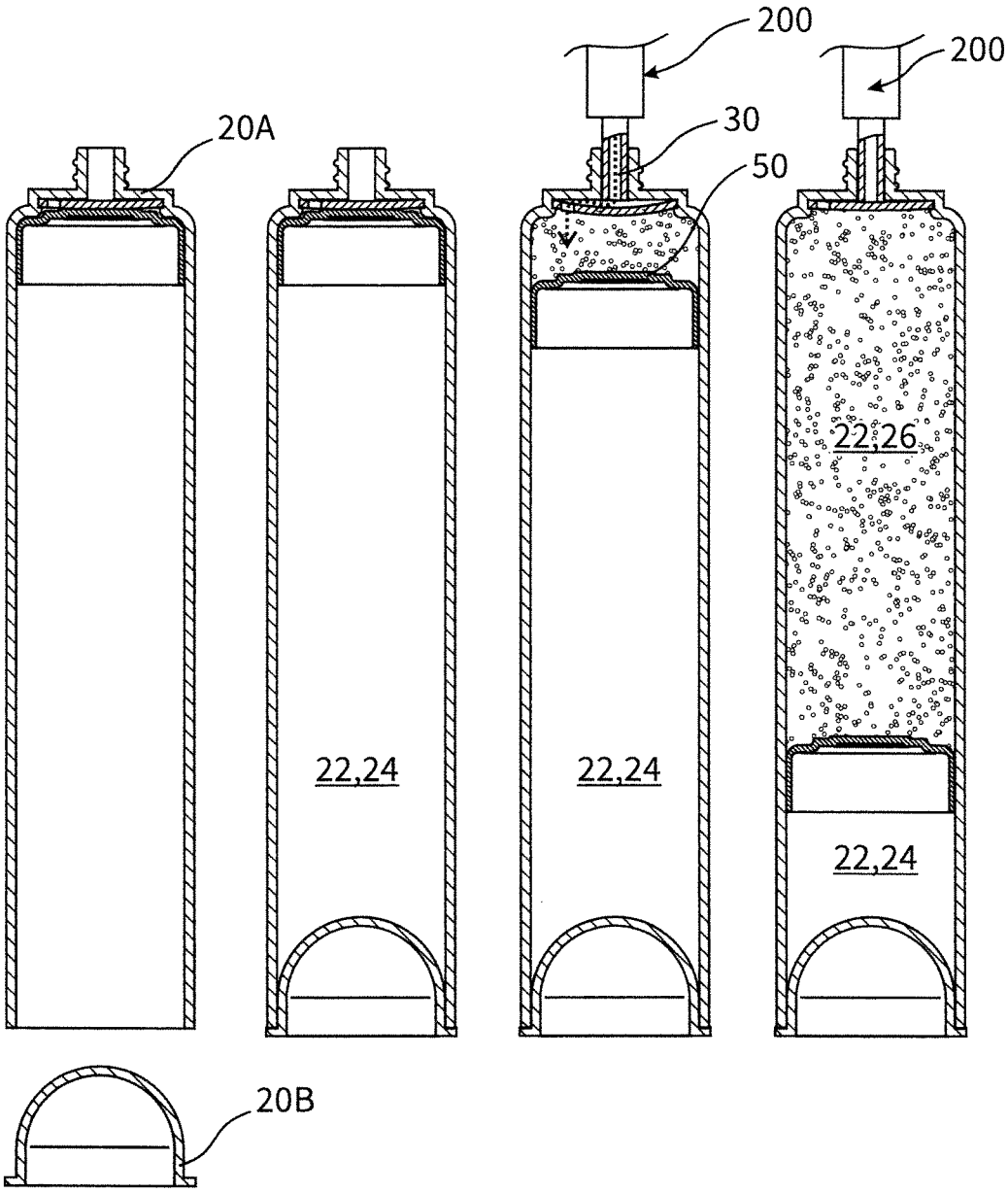
FIGS. 20A to 20D show a first filling method for filling a liquid cartridge according to FIG. 1.

In the filling procedure, provision is made according to FIG. 20A that the wall component 20B is not initially connected to the wall component 20A before the filling procedure. Instead, gas is fed into the pressure chamber 20 through the lower and still open end of the wall component 22A and through the opening provided there before the wall components 20A, 20B are joined, and then, in the manner illustrated by FIG. 20B, the wall component 20B is connected to the wall component 20A, for example by welding, especially by friction welding. In this state in FIG. 20B, there is therefore already an overpressure in the pressure chamber 22, usually an overpressure of 2 to 3 bar. Thereafter, the liquid cartridge 10 is supplied to the filler as per the intended purpose, which filler then allows liquid to flow through the outlet opening 30 through a filling stub 200 into the liquid chamber 26, as is shown in FIG. 20C. The liquid pushes the separating piston 50 downwards until the completely filled state of FIG. 20D is reached and the filling procedure is terminated.

Figures 21A, 21B, 21C, 21D:
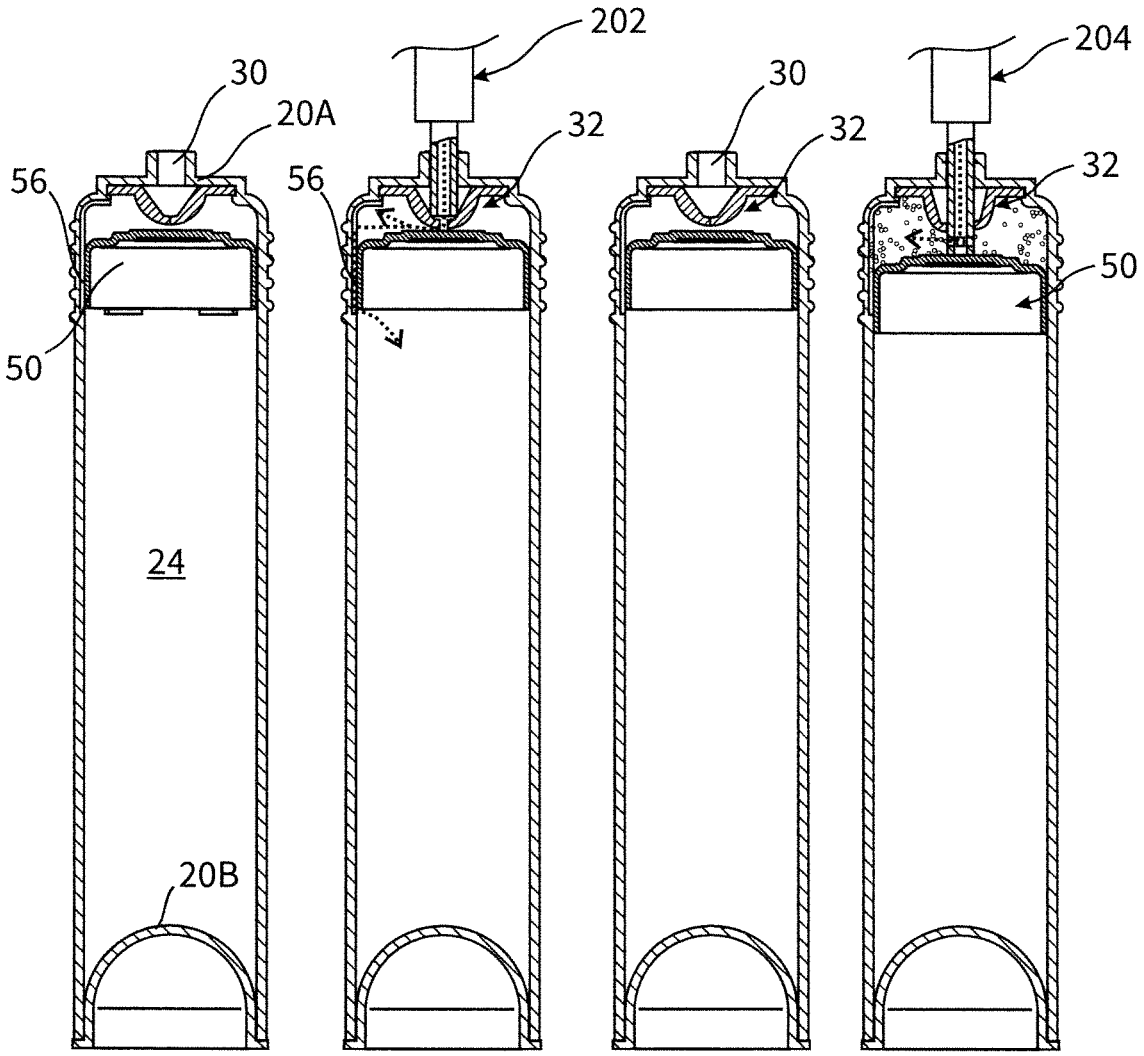
FIGS. 21A to 21E show a second filling method for filling a liquid cartridge according to FIG. 9.
Figure 21E:
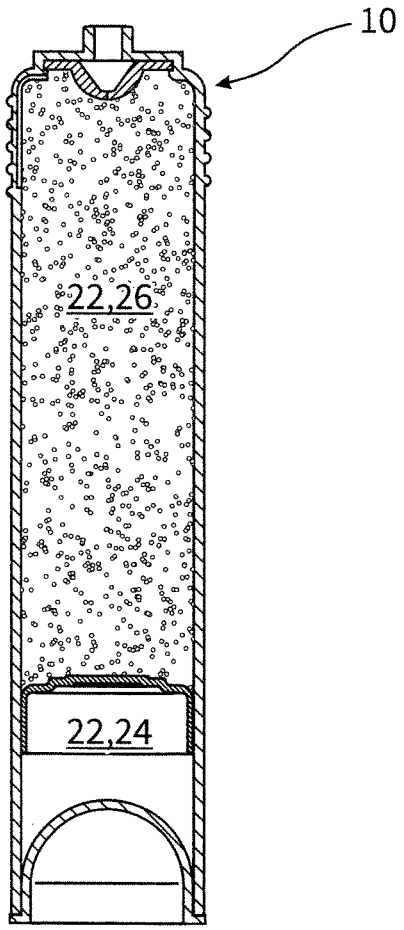

In the design according to FIGS. 21A to 21D, the wall components 20A, 20B are already connected to each other firmly and in a gas-tight manner before the filling procedure. For the filling procedure, a first filling stub 202 is first inserted through the outlet opening 30 in the manner illustrated by FIG. 21B, which opens the outlet valve 32 provided here and allows gas to flow into the pressure chamber 22. This gas can flow through a bypass channel 56 from the not yet filled liquid chamber 26 into the gas chamber 24. As soon as the desired gas pressure of about 2 to 3 is reached, the first filling stub 202 is pulled out of the outlet opening 30 and, in the manner illustrated by FIG. 21D, a second filling stub 204 is inserted into the outlet opening 30, being inserted to the extent that it is pushed through the outlet valve 32, comes into contact with the separating piston 50 and moves the latter further down from the initial position until it is pushed beyond the end of the bypass channel 56. This position of the separating piston 50 is shown in FIG. 21C. The filling with liquid now begins, the liquid being unable to pass the separating piston 50 to any relevant extent into the gas chamber 24. When the state shown in FIG. 21E is reached, the filling procedure is completed.

Figures 22A, 22B, 22C, 22D:
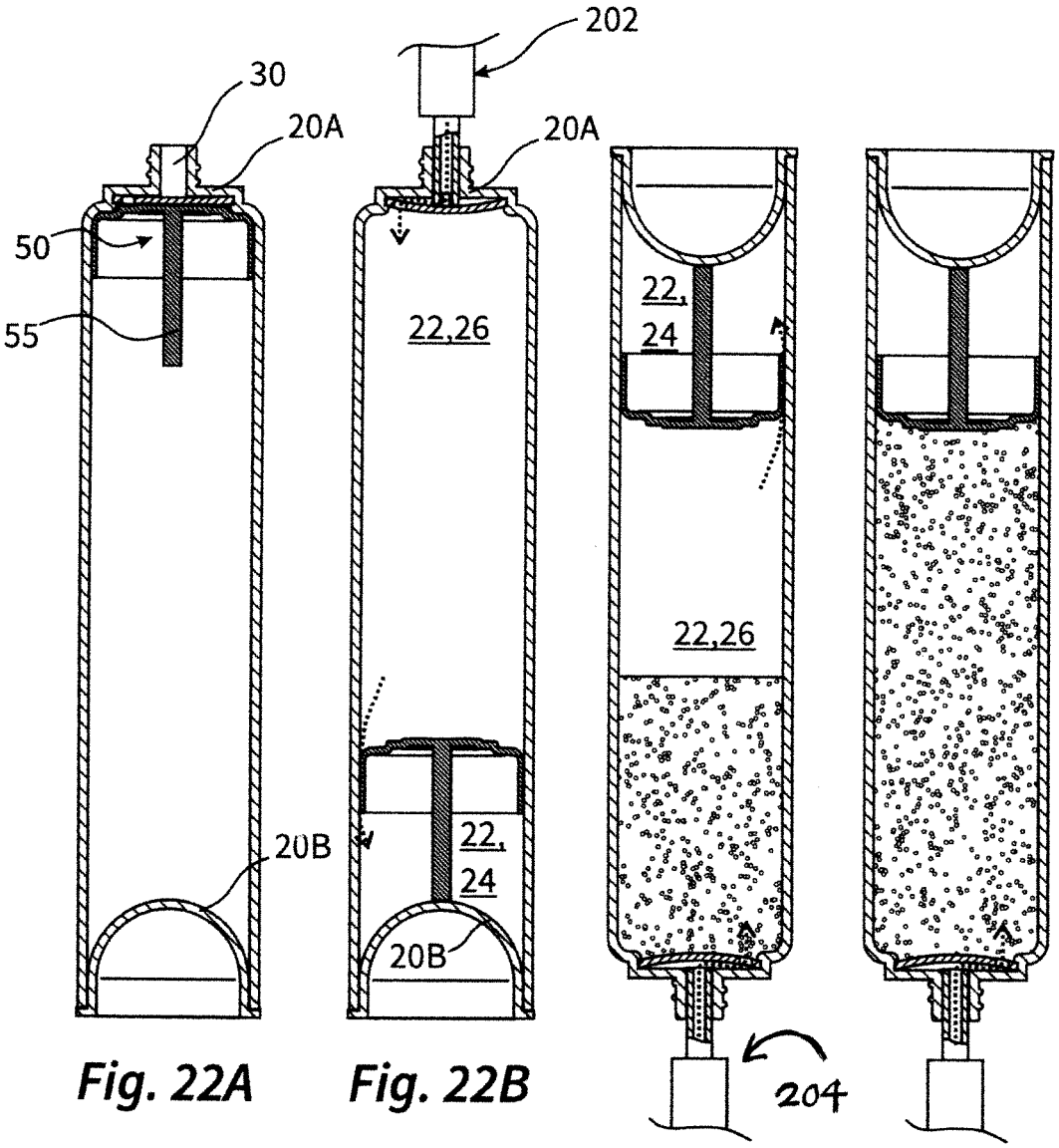
FIGS. 22A to 22D show a third filling method for filling a liquid cartridge according to FIG. 1.

FIGS. 22A to 22D show a further variant of the filling procedure. A spacer 55 is provided here on the separating piston 50. The method provides that, once again starting from the liquid cartridge 10 whose wall components 20A, 20B are already connected to each other in a gas-tight manner, gas is initially fed through the outlet opening 30 into the pressure chamber 22 by means of a first filling stub 202. This gas first enters the liquid chamber 26 and moves the separating piston 50 to a lower end position, in which, however, the gas chamber 24 still has a considerable volume, since the spacer 55 prevents the separating piston 50 from being pushed any further. This state is shown in FIG. 22B. The gas overpressure in the liquid chamber 26 causes gas to flow past the separating piston into the gas chamber 24.

In the manner illustrated in FIG. 22C, in an upside down position, liquid is then pressed from below into the liquid chamber 26 by means of a second filling stub 204. This liquid has the effect that the gas still present in the liquid chamber 26 at this time is forced past the separating piston 50 into the gas chamber 24. As soon as the state shown in FIG. 22D is reached, the filling procedure is completed.

It has been shown that, even after the liquid cartridge 10 is returned to its normal position with the outlet opening 30 pointing upwards, no mixing takes place to any relevant extent between the gas in the gas chamber 24 and the liquid in the liquid chamber 26. This is prevented, among other things, by the fact that the gas pressure in the gas chamber 24 widens the cup-like separating piston 50 and thus closes the gap between the separating piston and the lateral wall of the wall component 21.

Figure 23A:
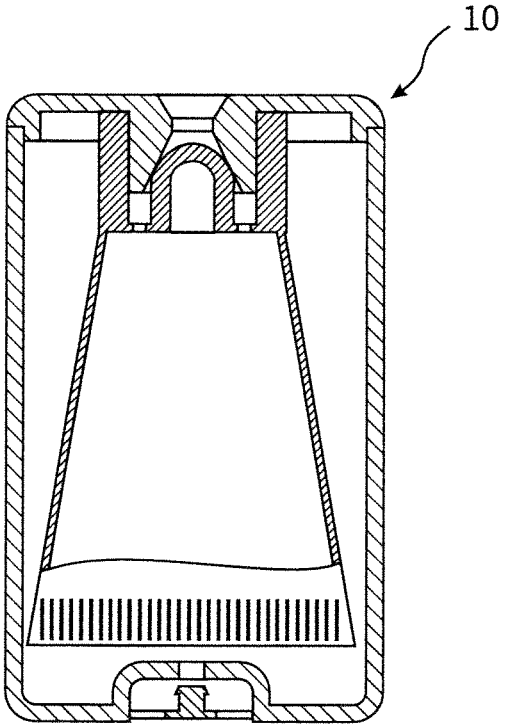
FIGS. 23A to 23D show a fourth filling method for filling a liquid cartridge according to FIG. 15.
Figure 23B:
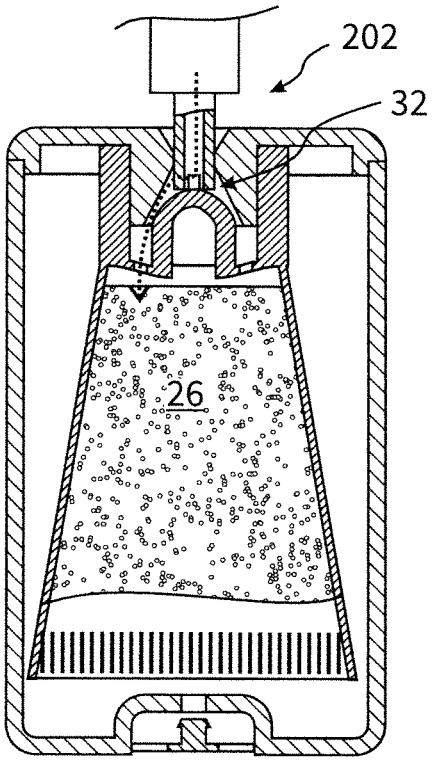

FIGS. 23A to 23D show the filling procedure in the case of the liquid cartridge from FIG. 17. Here, starting from the liquid cartridge of FIG. 23A, which is neither filled with gas nor with liquid, the tube, i.e. the liquid chamber 26, is initially filled by means of a first filling stub 202, wherein the filling nozzle 202 for this purpose mechanically opens the outlet valve 32. FIG. 23B shows the liquid filling procedure with the outlet valve 32 open.

Figure 23C:
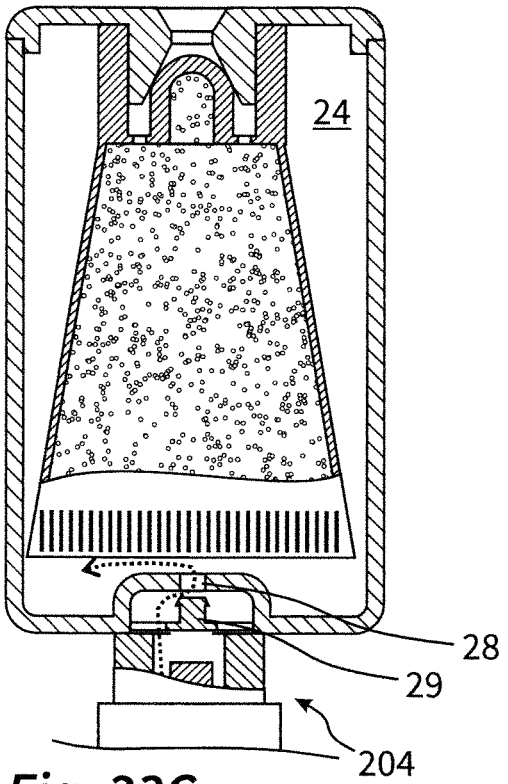
Figure 23D:
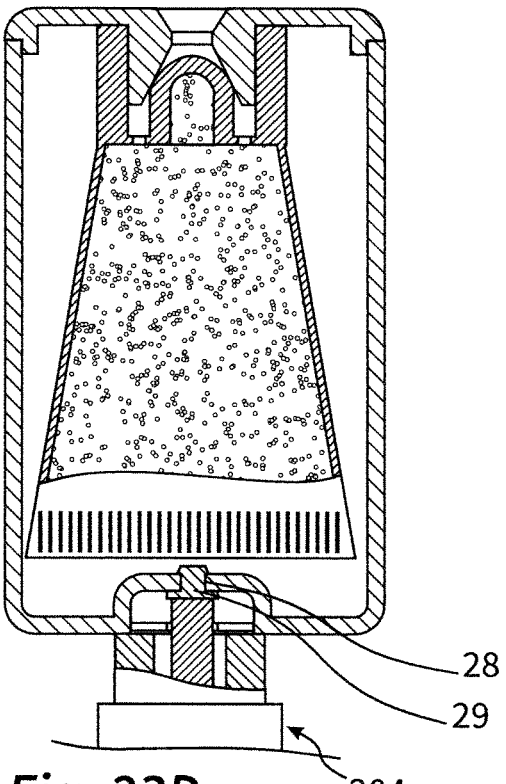

Thereafter, in the manner illustrated in FIG. 23C, a second filling stub 204 is applied in the region of the gas filling opening 28 and presses gas into the gas chamber 24. As soon as the desired gas pressure is reached, the plug component 29 already described with reference to FIG. 17 is pressed into the gas filling opening 28 by means of a closing pin, so that the gas can no longer escape through said opening.

Figure 24:
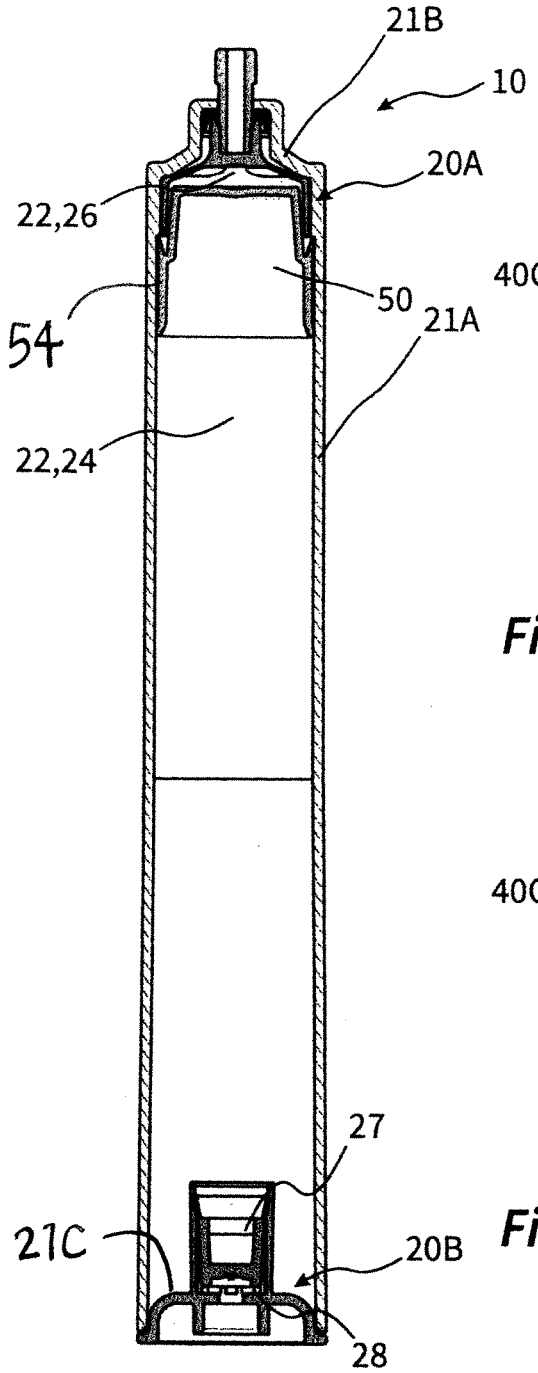
FIGS. 24 and 25A and 25B show a further exemplary embodiment of a liquid cartridge according to the invention.
Figure 25A:
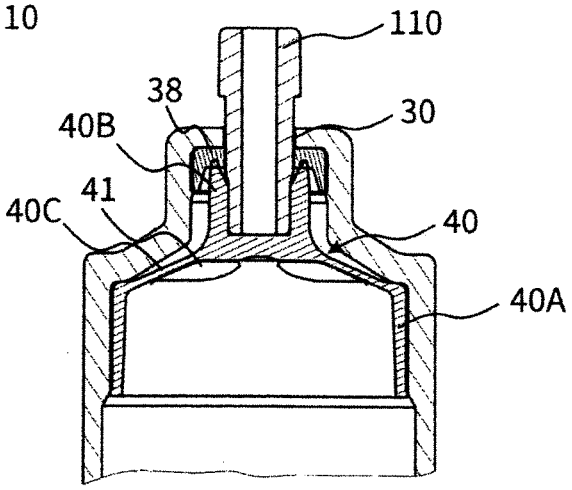
Figure 25B:
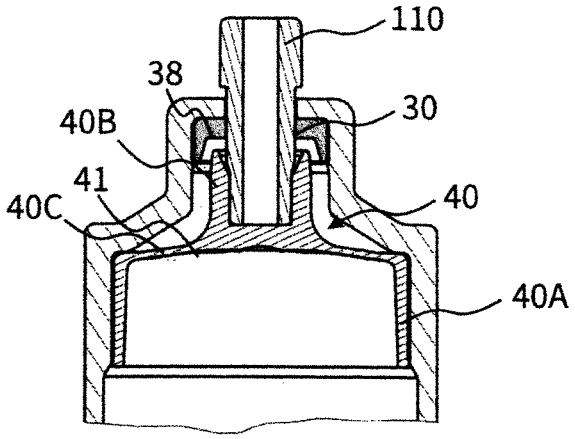

FIGS. 24 and 25A and 25B show a further embodiment of a liquid cartridge 10 according to the invention. Like the liquid cartridge of FIG. 1, this further liquid cartridge has an outer body made of PET and composed of two wall components 20A, 20B. The wall component 20A here forms a lateral wall 21A and an upper end wall 21B, in the region of which the outlet opening 30 is provided.

The wall component 20B forms a bottom end wall 21C, which has a curved shape and is connected in a gas-tight manner to the first wall component 20A, in particular by means of a welded connection or an adhesive bond. Together, the wall components 20A, 20B forming the outer body surround a pressure chamber 22, which is divided into a gas chamber 24 and a liquid chamber 26 by means of a separating piston 50. In addition to the actual partition wall 52, the separating piston 50 has a jacket section 54, which is displaceable by sliding along an inner side of the lateral wall 21A.

The outlet opening 30 is surrounded, on the inside, by a sealing component 38 with a sealing surface facing downwards and thus in the direction of the bottom.

At the upper end of the wall component 20A, an outlet valve component 40 is fitted. The outlet valve component 40 is preferably produced from PE or PP. In the region of an outer fastening region 40A, the outlet valve component 40 is secured on its outside by means of a clamping connection or latching connection. Alternatively, other joining techniques are also possible here, in particular plastic welding or adhesive bonding. The outlet valve component 40 has a central sealing region with a cup-like structure. The rim of this cup forms a sealing edge 40B which, in the closed state of the outlet valve, bears on the sealing component 38 and thus closes the access for liquid to the interior of the cup.

Between the fastening region 40A and the inner sealing edge 40B, a circumferential annular deformation region is provided, which is penetrated by through-openings 41. In this deformation region 40C, the wall thickness of the outlet valve component 40 is reduced so that, even when a comparatively rigid material is used, the lower wall thickness of the deformation region 40C and the through-openings 41 afford a sufficient deformability to enable opening of the valve.

FIGS. 25A and 25B show the closed position and the open position of the valve.

FIG. 25A shows the closed state. In this state, the sealing edge 41B bears on the sealing component 38, under the action of the slightly prestressed deformation region 40C, and prevents the escape of liquid. FIG. 25B shows the open state. This is achieved when a hollow opening stub 110, which can be part of the liquid cartridge 10 or can be part of a dispenser to which the liquid cartridge 10 is coupled, is pressed through the outlet opening 30 into the cup-like structure, while the outer side of the opening stub 110 is in sealing contact with the inner side of the sealing component 38.

By virtue of the resulting pressing-in of the cup-like structure, the sealing edge 40B is also lifted from the sealing component 38 counter to the restoring force of the deformation region 40C, and liquid can flow from the outside into the cup-like structure and flow through flow paths (not shown) into the opening stub 110. As soon as the application of external force to the opening stub 110 ceases, the latter returns to the position in FIG. 25A.

Another special feature of the design in FIGS. 24, 25A and 25B lies in the design of the gas filling opening 28 on the bottom-end wall component 20B. A valve component 27 widening in the direction of the gas chamber 24 is inserted into this gas filling opening 28. With an overpressure in the gas chamber 24, this valve component closes with an inner wall of the gas filling opening 28. For the purpose of filling the gas chamber 24, an overpressure is generated from the outside. This causes the valve to open and allows gas to flow into the gas chamber 24.

The design of the bottom and of the gas filling valve provided there on the one hand and the design of the outlet opening 30 with the outlet valve component 40 and the sealing component 38 on the other hand are independent of each other and can be used separately from each other in combination with the other exemplary embodiments. Thus, in particular, the design of the outlet valve in FIGS. 24 and 25A and 25B can also be combined with the design of the bottom in FIG. 1.

The invention claimed is:

1. A liquid cartridge for receiving pressurized liquid, comprising:

an outer body comprising at least two wall components and a pressure chamber for receiving pressurized gas and pressurized liquid, the outer body surrounding the pressure chamber;

an outlet opening penetrating one of the at least two wall components; and an outlet valve component held movably or secured on an inner side of the pressure chamber on at least one of the at least two wall components, the outlet valve component, in a closed state, preventing liquid from leaving the pressure chamber through the outlet opening, the outlet valve component being transferable to an open state by application of force from the outside, the pressure chamber comprising a displaceable or deformable partition wall dividing the pressure chamber into a gas chamber and a liquid chamber, the outlet valve component having a fastening region, the fastening region fastening the outlet valve component to one of the two wall components, the outlet valve component further including a circumferential sealing edge facing upwards in a direction of the outlet opening and, in the closed state of the outlet valve component, the sealing edge bears on an inner side of the one wall component or on a sealing component inserted into the one wall component, the sealing edge being deflectable by an opening pin or opening stub insertable from the outside, such that the outlet valve component is elastically deformed and liquid can flow past the sealing edge to the outlet opening.

2. The liquid cartridge according to claim 1, further comprising a valve mating surface on one of the at least two wall components, the outlet valve component closing by bearing on the valve mating surface.

3. The liquid cartridge according to claim 1, wherein the partition wall comprises a bag body comprising a flexible bag wall, the liquid chamber being disposed inside of the bag wall, and the gas chamber is provided between the bag wall and the outer body.

4. The liquid cartridge according to claim 1, wherein the outlet valve component has a cup-shaped depression for receiving the opening pin or opening stub, and a circumferential end edge of the cup-shaped depression is formed by the sealing edge.

5. The liquid cartridge according to claim 1, wherein the outlet valve component is deflectable by an opening pin or opening stub insertable from the outside such that the outlet valve component assumes an open state.

6. The liquid cartridge according to claim 1, wherein the wall components, the partition wall and the outlet valve component are made of materials recyclable in a common recycling process.

7. The cartridge according to claim 1, wherein the wall components, a separating piston or a bag and the outlet valve component each comprise a material from the group comprising polyethylene terephthalates (PET), polyethylenes (PE), polypropylenes (PP) and thermoplastic elastomers (TPE).

8. The liquid cartridge according to claim 6, wherein the liquid chamber is filled with a nicotine-containing and/or cannabis-containing liquid, or the liquid chamber is filled with a pharmaceutical liquid, or the liquid chamber is filled with a liquid for personal hygiene, or the liquid chamber is filled with a highly viscous liquid.

9. The liquid cartridge according to claim 1, including at least one of the following:

an outer side of the outer body includes an external thread or a bayonet for coupling to a discharge device; and/or the partition wall comprises a bag configured as a tube; and/or the outlet valve component has an actuation surface accessible through the outlet opening, the actuation surface, by application of force, causing a displacement of the outlet valve component into the open state; and/or the liquid chamber has a volume of at most 118 ml; and/or at least two of the at least two wall components are connected to each other via a welded connection, the welded connection comprising a laser-welded connection, a friction-welded connection or an ultrasound-welded connection; and/or at least two of the at least two wall components are connected to each other to form an interference fit, and a coupling device is provided and comprises a threaded connection, and at least one of the at least two wall components comprises a conical widening or constriction in order to achieve the interference fit when screwing in; and/or at least two of the at least two wall components are connected to each other by an adhesive bond; and/or in at least one of the at least two wall components, a gas filling opening is provided and leads into the gas chamber, the one wall component having a valve device closed by overpressure in the gas chamber; and/or at least one of the wall components is produced from a transparent plastic; and/or in one of the wall components, a gas filling opening is provided and leads into the gas chamber, and the gas filling opening is provided with a plug component preventing the gas from leaving the pressure chamber; and/or the at least two wall components comprises exactly two wall components, the outer body being assembled from the exactly two wall components.

10. The liquid cartridge according to claim 1, wherein the partition wall comprises a separating piston movable by sliding along an inner side of the outer body, the gas chamber is disposed on a side of the separating piston facing away from the outlet opening, and the liquid chamber is provided on a side of the separating piston facing the outlet opening.

11. The liquid cartridge according to claim 10, further comprising at least one of the following:

the separating piston has a cup-shaped structure open to the gas chamber, and sides of the cup-shaped structure are formed by a lateral surface of the separating piston; and/or the separating piston has an asymmetrical design causing a radial expansion of the separating piston when there is an overpressure in the gas chamber relative to the liquid chamber; and/or a bypass channel is provided on an inner side of the outer body and, when the separating piston is arranged in a region of the bypass channel, the bypass channel permits flow around the separating piston; and/or the separating piston and/or a bottom end wall of the outer body and/or a lateral surface of the outer body is provided with a stop surface and/or with a spacer, the stop surface and/or the spacer ensuring a minimum distance between the bottom end wall and the separating piston.

12. The liquid cartridge according to claim 1, wherein the outlet valve component has a deformation region between the fastening region and the sealing edge, the deformation region having a reduced stiffness and/or a reduced wall thickness compared to the fastening region and the sealing edge.

13. The liquid cartridge according to claim 12, wherein at least one through-opening for liquid is provided in the deformation region.

14. The liquid cartridge according to claim 1, wherein the at least two wall components comprises a first wall component and a second wall component, the first wall component comprising in one piece a lateral wall and a first end wall, the first end wall comprising the outlet opening, and the second wall component forms a bottom end wall opposite the outlet opening.

15. The liquid cartridge according to claim 14, wherein the partition wall comprises a separating piston, and the first wall component has an inner side forming a cylindrical sliding surface along which the separating piston slides.

16. Athe liquid dispenser for discharging liquid, comprising:

a discharge device; and a liquid cartridge fastened to or in the discharge device, the liquid cartridge comprising:

an outer body comprising at least two wall components and a pressure chamber for receiving pressurized gas and pressurized liquid, the outer body surrounding the pressure chamber;

an outlet opening penetrating one of the at least two wall components; and an outlet valve component held movably or secured on an inner side of the pressure chamber on at least one of the at least two wall components, the outlet valve component, in a closed state, preventing liquid from leaving the pressure chamber through the outlet opening, the outlet valve component being transferable to an open state by application of force from the outside, the pressure chamber comprising a displaceable or deformable partition wall dividing the pressure chamber into a gas chamber and a liquid chamber;

the discharge device further comprising a receiving chamber for receiving the liquid cartridge.

17. The liquid dispenser according to claim 16, wherein the discharge device has an actuation surface for manual actuation, the actuation surface being coupled to an opening pin or opening stub, and the actuation surface, when actuated, applies force to and opens the outlet valve component.

18. The liquid dispenser according to claim 16, wherein the discharge device has a discharge nozzle device including a plurality of outlet nozzle openings.

19. The liquid dispenser according to claim 16, further including at least one of the following:

the receiving chamber is partially bounded by a lateral surface having an inner side with an internal thread, the outer body having an outer side with an external thread corresponding to the internal thread; and/or the receiving chamber is partially bounded by a lateral surface comprising a transparent plastic.

20. The liquid dispenser according to claim 16, wherein the discharge device has an opening pin or an opening stub for opening the outlet valve component, the opening pin or opening stub protruding through the outlet opening into the liquid cartridge.

21. The liquid dispenser according to claim 20, wherein:

the discharge device has a discharge valve and an actuation surface, the discharge valve being manually switchable by the actuation surface; and/or the opening stub has a sleeve-shaped form and an outer side, the outer side having a diameter that bears sealingly against an inner side of the outlet opening.

22. A method for filling a liquid cartridge including an outer body having at least two wall components and a pressure chamber for receiving pressurized gas and pressurized liquid, the outer body surrounding the pressure chamber, an outlet opening penetrating one of the at least two wall components, and an outlet valve component held movably or secured on an inner side of the pressure chamber on at least one of the at least two wall components, the outlet valve component, in a closed state, preventing liquid from leaving the pressure chamber through the outlet opening, the outlet valve component being transferable to an open state by application of force from the outside, the pressure chamber comprising a displaceable or deformable partition wall dividing the pressure chamber into a gas chamber and a liquid chamber, the partition wall comprising a separating piston, wherein:

first, gas is introduced into the pressure chamber and enters the liquid chamber and the gas chamber, and then, in a position of the liquid cartridge with the liquid chamber arranged at the bottom, liquid is introduced from below into the liquid chamber and at least part of the gas is displaced from the liquid chamber into the gas chamber; and/or the separating piston between the liquid chamber and the gas chamber is located in a holding position at the start of the introduction of the gas, from which holding position the separating piston is released during the introduction by a pressure surge or by a tool inserted through the outlet opening.

23. A liquid dispenser for discharging liquid, comprising:

a discharge device; and a liquid cartridge fastened to or in the discharge device, the liquid cartridge comprising:

an outer body comprising at least two wall components and a pressure chamber for receiving pressurized gas and pressurized liquid, the outer body surrounding the pressure chamber;

an outlet opening penetrating one of the at least two wall components; and an outlet valve component held movably or secured on an inner side of the pressure chamber on at least one of the at least two wall components, the outlet valve component, in a closed state, preventing liquid from leaving the pressure chamber through the outlet opening, the outlet valve component being transferable to an open state by application of force from the outside, the pressure chamber comprising a displaceable or deformable partition wall dividing the pressure chamber into a gas chamber and a liquid chamber, the outlet valve component having a fastening region, the fastening region fastening the outlet valve component to one of the two wall components, the outlet valve component further including a circumferential sealing edge facing upwards in a direction of the outlet opening and, in the closed state of the outlet valve component, the sealing edge bears on an inner side of the one wall component or on a sealing component inserted into the one wall component, the sealing edge being deflectable by an opening pin or opening stub insertable from the outside, such that the outlet valve component is elastically deformed and liquid can flow past the sealing edge to the outlet opening.

* * * * *